US011685626B2

(12) United States Patent
Nakahata et al.

(10) Patent No.: US 11,685,626 B2
(45) Date of Patent: Jun. 27, 2023

(54) MEDIUM ALIGNING DEVICE, MEDIUM PROCESSING APPARATUS, AND RECORDING SYSTEM

(71) Applicant: SEIKO EPSON CORPORATION, Tokyo (JP)

(72) Inventors: Akinobu Nakahata, Shiojiri (JP); Tsuyoshi Furumido, Shiojiri (JP); Masaki Miyazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 177 days.

(21) Appl. No.: 16/883,010

(22) Filed: May 26, 2020

(65) Prior Publication Data

US 2020/0377326 A1 Dec. 3, 2020

(30) Foreign Application Priority Data

May 28, 2019 (JP) ..... 2019-099526

(51) Int. Cl.
*B65H 31/34* (2006.01)

(52) U.S. Cl.
CPC ..... *B65H 31/34* (2013.01); *B65H 2301/4212* (2013.01); *B65H 2405/35* (2013.01); *B65H 2801/06* (2013.01)

(58) Field of Classification Search
CPC ..... B65H 31/34; B65H 2405/1142; B65H 2405/114; B65H 2405/1122; B65H 2301/4212
See application file for complete search history.

(56) References Cited

U.S. PATENT DOCUMENTS 10,822,191 B2 * 11/2020 Johnson ..... B65H 29/12
2020/0399085 A1 * 12/2020 Furumido ..... B65H 31/3081

FOREIGN PATENT DOCUMENTS

JP 2009-263026 A 11/2009

* cited by examiner

*Primary Examiner* — Howard J Sanders
(74) *Attorney, Agent, or Firm* — Workman Nydegger

(57) ABSTRACT

A medium aligning device includes a stacking tray that stacks a medium discharged by a discharge section that discharges the medium, a side end aligning portion that is movable in a width direction that is a direction intersecting with a medium discharge direction of the discharge section, and positions and aligns a side end in the width direction of the medium stacked on the stacking tray, a rear end aligning portion that is movable in the width direction and positions and aligns a rear end that is an upstream end of the medium stacked on the stacking tray in the discharge direction, and a transmission portion that transmits the movement of the side end aligning portion in the width direction to the rear end aligning portion, in which a play in the width direction is provided between the side end aligning portion and the transmission portion.

7 Claims, 17 Drawing Sheets

MEDIUM ALIGNING DEVICE, MEDIUM PROCESSING APPARATUS, AND RECORDING SYSTEM

The present application is based on, and claims priority from JP Application Serial Number 2019-099526, filed May 28, 2019, the disclosure of which is hereby incorporated by reference herein in its ultimately.

BACKGROUND

1. Technical Field

The present disclosure relates to a medium aligning device for aligning a medium, a medium processing apparatus including the medium aligning device, and a recording system including the medium processing apparatus.

2. Related Art

A processing apparatus that performs processing such as a stapling processing and a punching processing on a medium such as a sheet is known in the related art, and an example of the processing device is disclosed in JP-A-2009-263026.

The sheet processing apparatus described in JP-A-2009-263026 includes a processing tray for stacking sheets, a sheet end restricting section for restricting the position of the rear end of the sheet on the processing tray, and a side aligning section for aligning the position of the side edge of the sheet on the processing tray. The side aligning section and the sheet end restricting section are respectively movable in the width direction of the sheet carried into the processing tray, and the side aligning section and the sheet end restricting section move together with each other in the sheet width direction on the processing tray. However, the sheet end restricting section and the side aligning section are connected by a connecting spring, and the movement stroke of the side aligning section is set longer than the movement stroke of the sheet end restricting section. Thus, the arrangement layout of the bundle discharging section for discharging the processed sheet bundle to the outside of the tray is not restricted.

In the configuration described in JP-A-2009-263026, when the side aligning section moves in the center direction in the sheet width direction, the sheet end restricting section moves in conjunction therewith. After the side aligning section reaches a predetermined position, the movement of the sheet end restricting section stops, and only the side aligning section moves in the center direction.

However, in the outer area in the sheet width direction, the sheet end restricting section is configured to move completely following the movement of the side aligning section. Therefore, when the side aligning section moves in small increments in the sheet width direction and hits the side edge of the sheet, and the sheet aligning operation is performed, the sheet end restricting section also moves following the movement. In spite of the operation of aligning the side edges of the sheet, the rear end of the sheet moves in the sheet width direction, and the aligning state may be disturbed. In addition, there is a possibility that the sheet end restricting section may rub the rear end of the sheet and generate paper dust and the like.

SUMMARY

According to an aspect of the present disclosure, there is provided a medium aligning device including a stacking tray that stacks a medium discharged by a discharge section that discharges the medium, a side end aligning portion that is movable in a width direction that is a direction intersecting with a medium discharge direction of the discharge section, and positions and aligns a side end in the width direction of the medium stacked on the stacking tray, a rear end aligning portion that is movable in the width direction and positions and aligns a rear end that is an upstream end of the medium stacked on the stacking tray in the discharge direction, and a transmission portion that transmits the movement of the side end aligning portion in the width direction to the rear end aligning portion, in which a play in the width direction is provided between the side end aligning portion and the transmission portion.

DESCRIPTION OF EXEMPLARY EMBODIMENTS

Figure 1:
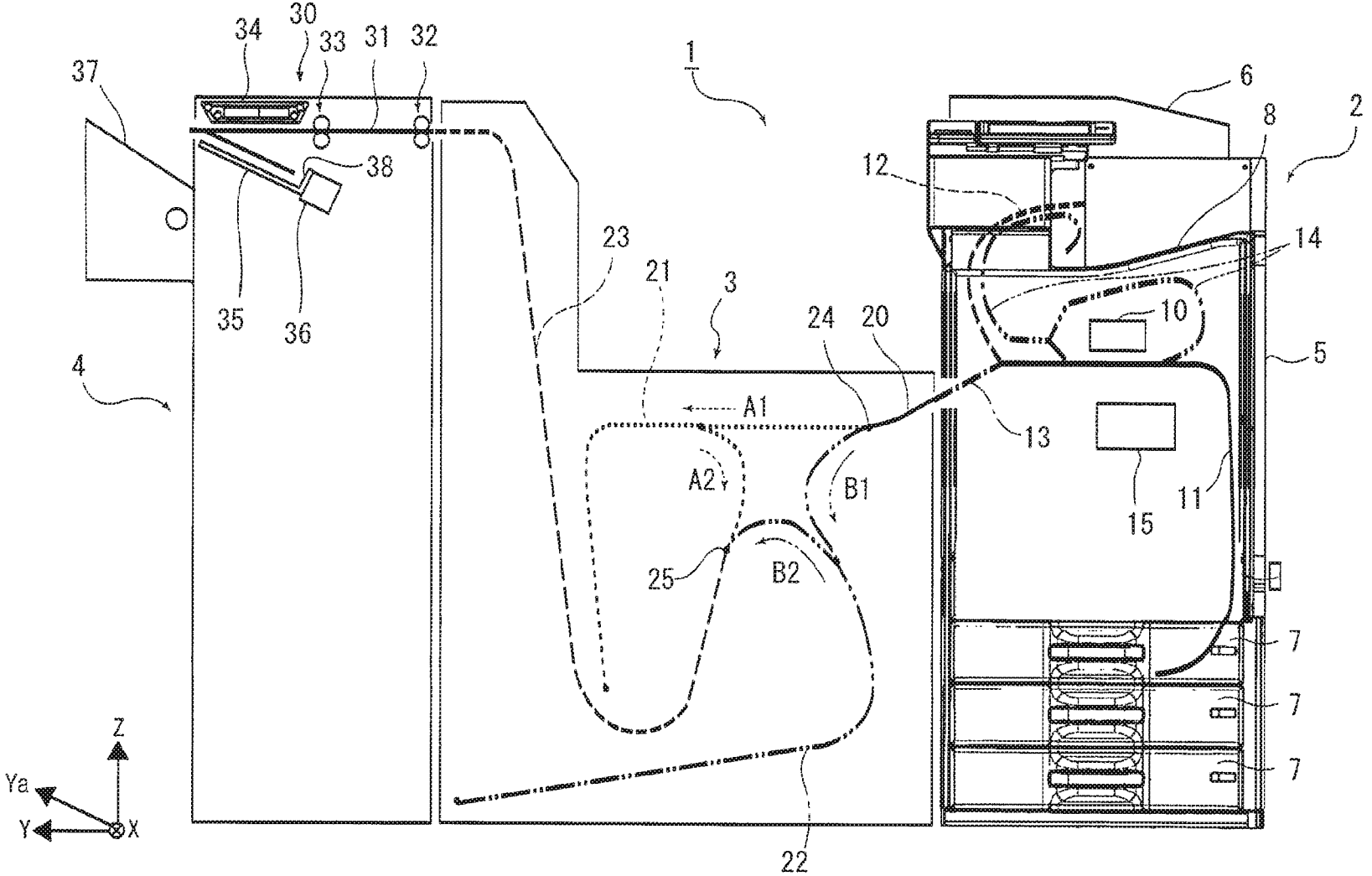
FIG. 1 is a schematic view of a recording system.

Hereinafter, the present disclosure will be schematically described.

The medium aligning device according to the first aspect includes a stacking tray that stacks a medium discharged by a discharge section that discharges the medium, a side end aligning portion that is movable in a width direction that is a direction intersecting with a medium discharge direction of the discharge section, and positions and aligns a side end in the width direction of the medium stacked on the stacking tray, a rear end aligning portion that is movable in the width direction and positions and aligns a rear end that is an upstream end of the medium stacked on the stacking tray in the discharge direction, and a transmission portion that transmits the movement of the side end aligning portion in the width direction to the rear end aligning portion, in which a play in the width direction is provided between the side end aligning portion and the transmission portion.

According to this aspect, the play in the width direction is provided between the rear end aligning portion and the transmission portion that transmits the movement of the side end aligning portion in the width direction to the rear end aligning portion. Therefore, when the side end aligning portion performs an operation of hitting the side end of the medium, the rear end aligning portion can be prevented from following the movement, and the aligning state of the medium can be suppressed from being disturbed. In addition, it is possible to prevent the rear end aligning portion from rubbing the rear end of the medium.

In a second aspect based on the first aspect, when a direction from a center position of the medium in the width direction toward the side end is an outward direction and a direction from the side end toward the center position is an inward direction, an outward movement limit position of the rear end aligning portion in the width direction is located in the inward direction from an outward movement limit position of the side end aligning portion, and an inward movement limit position of the rear end aligning portion in the width direction is located in the outer direction from an inward movement limit position of the side end aligning portion.

According to this aspect, the outward movement limit position of the rear end aligning portion in the width direction is located in the inward direction from the outward movement limit position of the side end aligning portion. When processing is performed on the corner of the rear end of the medium by the processing portion that performs processing on the medium, the rear end aligning portion is unlikely to be in the way, and the processing by the processing portion can be performed appropriately.

In addition, since the inward movement limit position of the rear end aligning portion in the width direction is located in the outward direction from the inward movement limit position of the side end aligning portion, it is possible to prevent the rear end processing portion from interfering with other components such as a section that discharges the medium in the discharge direction.

In a third aspect based on the second aspect, the rear end aligning portion is provided with an abutting portion that is located upstream of the stacking tray in the discharge direction, that is configured to advance and retreat with respect to a movement area in the width direction of a processing portion that performs processing on the medium, and that abuts on the processing portion in a state in which the abutting portion is advanced into the movement area, and an advance and retreat restricting section that makes the rear end aligning portion movable in the outward direction following the processing portion by retracting the abutting portion from the movement area of the processing portion when the processing portion abuts on the abutting portion while moving in the inward direction and maintaining the abutting portion at the advanced position when the processing portion abuts on the abutting portion while moving in the outward direction.

According to this aspect, the processing portion can move the rear end aligning portion in the outward direction by the function of the advance and retreat restricting section, so that the processing portion can perform processing at an appropriate position. Further, when the processing portion moves in the inward direction, the abutting portion can be retracted from the movement area of the processing portion, so that the position of the rear end aligning portion can be maintained, and the unnecessary movement of the rear end aligning portion can be suppressed.

In a fourth aspect based on the third aspect, the rear end aligning portion and the transmission portion are configured separately from each other and provided so as to be displaceable in the width direction, respectively, and a return spring is provided between the rear end aligning portion and the transmission portion, and when the processing portion moves in the inward direction after the rear end aligning portion moves in the outward direction by the processing portion, the rear end aligning portion returns to the inward direction by a spring force of the return spring.

According to this aspect, a return spring is provided between the rear end aligning portion and the transmission portion, and when the processing portion moves in the inward direction after the rear end aligning portion moves in the outward direction by the processing portion, the rear end aligning portion returns to the inward direction by a spring force of the return spring. Therefore, the rear end aligning portion can return to a position where the rear end of the medium can be properly aligned.

In a fifth aspect based on the third aspect, the advance and retreat restricting section includes a rotation member configured to rotate and rotatably support the abutting portion, a first spring that is provided between the abutting portion and the rotation member, and applies a spring force to the abutting portion in a direction in which the abutting portion advances into the movement area of the processing portion, and a second spring that is provided between a base member on which the rear end aligning portion is provided and the rotation member, and applies a spring force to the rotation member in a direction in which the abutting portion projects into the movement area of the processing section, the abutting section is configured to advance and retreat with respect to the movement area of the processing section by rotating with respect to the rotation member and is configured to advance and retreat with respect to the movement area of the processing section with rotation of the rotation member, the abutting portion is supported by the rotation member so as to be rotatable with respect to the rotation member when the processing portion moving in the inward direction abuts on the abutting portion, and so as to be unrotatable with respect to the rotation member when the processing portion moving in the outward direction abuts on the abutting portion, when the processing portion moving in the inward direction abuts on the abutting portion, the abutting portion rotates with respect to the ab member against the spring force of the first spring so that the abutting section is retracted from the movement area of the processing section, and when the processing portion moving in the outward direction abuts on the abutting portion, the abutting portion and the rotation member do not rotate together, and a state in which the abutting portion is advanced into the movement area of the processing portion is maintained by the spring force of the second spring so that the rear end aligning section moves in the outward direction.

In a sixth aspect based on the fifth aspect, the advance and retreat restricting section retracts the abutting portion to permit the processing portion to move in the outward direction when the processing portion further moves in the outward direction after the rear end aligning portion is moved to outward movement limit position by the processing portion moving in the outward direction.

According to this aspect, the advance and retreat restricting section retracts the abutting portion to permit the processing portion to move in the outward direction when the processing portion further moves in the outward direction after the rear end aligning portion is moved to outward movement limit position by the processing portion moving in the outward direction. Therefore, the processing portion can perform processing on the corner of the rear end of the medium.

In a seventh aspect based on the sixth aspect, when the processing portion further moves in the outward direction after the rear end aligning portion is moved to the outward movement limit position by the processing portion moving in the outward direction, the second spring extends so that the abutting portion retracts from the movement area of the processing portion, and the movement of the processing portion in the outward direction is permitted.

The medium processing apparatus according to the eighth aspect includes the medium aligning device according to the third to seventh aspect that is disposed on both sides with respect to a center position in a width direction that is a direction intersecting with a medium discharge direction, and the processing portion.

According to this aspect, in the medium processing apparatus, the same operation and effect as any of the first to seventh aspects can be obtained.

The recording system according to a ninth aspect includes a recording unit including a recording section that performs recording on a medium, and the medium processing apparatus according to the eighth aspect that performs processing on the medium after recording in the recording unit.

According to this aspect, in the recording system, the operation and effect of the eighth aspect can be obtained.

Hereinafter, the present disclosure will be described specifically.

The X-Y-Z coordinate system shown in each figure is a rectangular coordinate system, and the X-axis direction is the width direction of the medium and also the depth of the device. The Y-axis direction is the device width direction, and the Z-axis direction is the vertical direction, that is, the device height direction. Further, the Ya-axis direction indicates a medium discharge direction in a medium discharge device 30 described later, and in the present embodiment, the +Ya direction and the +Y direction form an acute angle. The +Ya direction of the Ya-axis direction is the medium discharge direction in the medium discharge device 30 and is downstream in the medium discharge direction. The −Ya direction is the opposite direction to the medium discharge direction in the medium discharge device 30 and is upstream in the medium discharge direction. The X-axis direction is a width direction that is a direction intersecting the Ya-axis direction.

A recording system 1 shown in FIG. 1 includes, as an example, a recording unit 2, an intermediate unit 3, and a processing unit 4 in order from right to left in FIG. 1.

The recording unit 2 includes a line head 10 as a recording section for recording on a medium. The medium includes a recording sheet as an example, and the medium is hereinafter referred to as a medium P.

The intermediate unit 3 receives the medium P after recording from the recording unit 2 and transfers the medium P to a processing unit 4 which is an example of a medium processing apparatus. The processing unit 4 includes a medium discharge device 30 that discharges the medium P after recording in the recording unit 2, and a processing portion 36 that performs a predetermined process on the medium P mounted on a first tray 35 as a stacking tray provided in the medium discharge device 30. The first tray 35 is provided with medium aligning devices 9A and 9B (see FIG. 4) described later.

In the recording system 1, the recording unit 2, the intermediate unit 3, and the processing unit 4 are coupled to each other so that the medium P can be transported from the recording unit 2 to the processing unit 4.

The recording system 1 is configured to input a recording operation on the medium P in the recording unit 2, the intermediate unit 3, and the processing unit 4 from an operation panel (not shown). The operation panel can be provided in the recording unit 2 as an example.

Hereinafter, the schematic configurations of the recording unit 2, the intermediate unit 3, and the processing unit 4 will be described in this order.

The recording unit 2 shown in FIG. 1 is configured as a multifunction machine including a printer portion 5 including the line head 10 that performs recording by ejecting ink, which is an example of a liquid, onto a medium P, and a scanner portion 6. In the present embodiment, the printer portion 5 is configured as a so-called ink jet printer.

A plurality of medium accommodation cassettes 7 are provided below the recording unit 2. The medium P accommodated in the medium accommodation cassette 7 is sent to the recording area by the line head 10 through the transport path 11 indicated by a solid line in the recording unit 2 in FIG. 1 and the recording operation is performed. The medium P after recording by the line head 10 is sent to either a first discharge path 12 which is a path for discharging the medium P to a post-recording discharge tray 8 provided above the line head 10 or a second discharge path 13 which is a path for sending the medium P to the intermediate unit 3. In the recording unit 2 of FIG. 1, the first discharge path 12 is indicated by a broken line, and the second discharge path 13 is indicated by a dashed line.

The recording unit 2 includes a reversing path 14 indicated by a two-dot chain line, and is configured to perform double-sided recording in which the medium P is reversed and recording is performed on the second surface after recording on the first surface of the medium P.

In each of the transport path 11, the first discharge path 12, the second discharge path 13, and the reversing path 14, one or more pairs of transport rollers (not shown) are disposed as an example of a section that transports the medium P.

The recording unit 2 is provided with a control portion 15 that controls operations related to the transport and recording of the medium P in the recording unit 2. The control portion 15 can be configured to control not only the recording unit 2 but also various operations in the processing unit 4 described below.

The intermediate unit 3 is disposed between the recording unit 2 and the processing unit 4, is configured to receive the medium P after recording transferred from the second discharge path of the recording unit 2 via a receiving path 20, and transport the medium P to the processing unit 4. The receiving path 20 is indicated by a solid line in the intermediate unit 3 shown in FIG. 1.

In the intermediate unit 3, there are two transport paths for transporting the medium P. The first transport path is a path for the medium P to be transported from the receiving path 20 via a first switchback path 21 to a discharge path 23. The second path is a path for the medium P to be transported from the receiving path 20 via a second switchback path 22 to the discharge path 23.

The first switchback path 21 is a path for receiving the medium in the direction of arrow A1 and then switching back the medium P in the direction of arrow A2. The second switchback path 22 is a path for receiving the medium in the direction of arrow B1 and then switching back the medium in the direction of arrow B2.

The receiving path 20 branches into the first switchback path 21 and the second switchback path 22 at a branching portion 24. Further, the first switchback path 21 and the second switchback path 22 join at a junction 25. Therefore, even if the medium P is sent from the receiving path 20 to any of the switchback paths, the medium P can be transferred to the processing unit 4 from the common discharge path 23.

In each of the receiving path 20, the first switchback path 21, the second switchback path 22, and the discharge path 23, one or more transport roller pairs (not shown) are disposed.

When recording is continuously performed on a plurality of media P in the recording unit 2, the medium P that has entered the intermediate unit 3 is alternately sent to a transport path passing through the first switchback path 21 and a transport path passing through the second switchback path 22. As a result, it is possible to increase the medium transport throughput in the intermediate unit 3.

It is also possible to adopt a recording system in which the intermediate unit 3 is omitted. That is, the processing unit can be directly coupled to the recording unit 2.

When the medium P after recording in the recording unit 2 is sent to the processing unit 4 via the intermediate unit 3, the transport time is longer than when the medium P is sent directly from the recording unit 2 to the processing unit 4, so that the ink of the medium P can be further dried before being transported to the processing unit 4.

The processing unit 4 includes the medium discharge device 30 that discharges the medium P received from the intermediate unit 3. The medium discharge device 30 includes the first tray 35 and a second tray 37, and is configured to perform processing on the medium discharged to the first tray 35 in the processing portion 36 and discharge the medium to the second tray 37. Examples of the processing performed by the processing portion 36 include a stapling processing and a punching processing. In the present embodiment, the medium discharge device 30 discharges the medium P that has been transferred from the discharge path 23 of the intermediate unit 3 and transported through the transport path 31.

The processing unit 4 includes a first transport roller pair 32 and a second transport roller pair 33 that transport the medium P in the +Y direction, and transports the medium P toward the medium discharge device 30.

Figure 2:
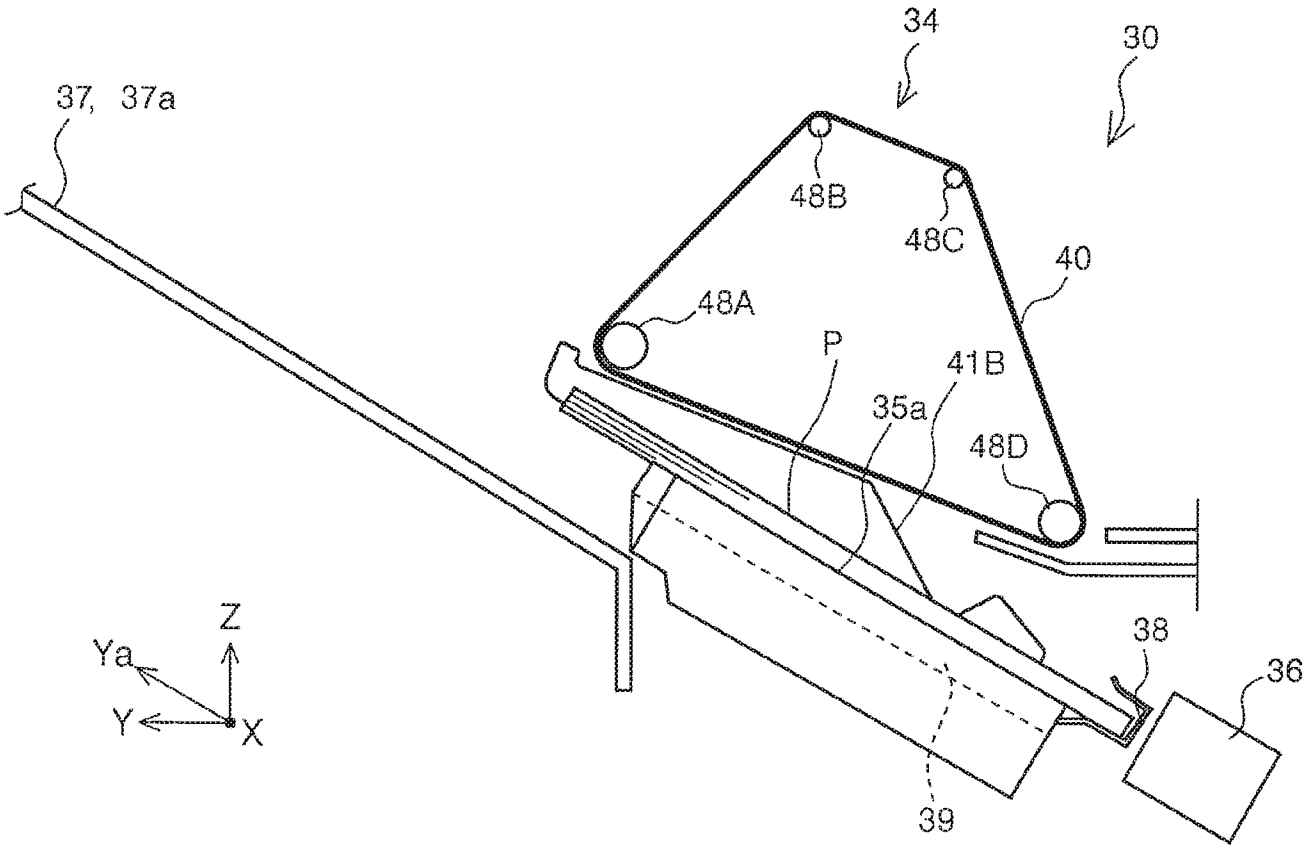
FIG. 2 is a side view of a medium processing apparatus.

In the +Y direction with respect to the second transport roller pair 33, a transport section 34 constituting the medium discharge device 30 is disposed. The transport section 34 transports the medium P by a transport belt 40 as shown in FIG. 2. The transport section 34 is configured to transport the medium P in both the +Ya direction and the −Ya direction.

More specifically, the transport belt 40 in the transport section 34 is configured to transport the medium P in the +Ya direction and the −Ya direction by rotating while adsorbing the medium P. The transport belt 40 is disposed above the transported medium P. That is, the transport belt 40 is configured to transport the medium P by adsorbing from above.

The annular transport belt 40 is wound around four rollers of a first roller 48A, a second roller 48B, a third roller 48C, and a fourth roller 48D. The fourth roller 48D is configured to be rotatable both clockwise and counterclockwise in FIG. 2 by the power of a driving source (not shown).

When the fourth roller 48D rotates clockwise, the transport belt 40 also rotates clockwise, and the medium P adsorbed on the transport belt 40 is transported in the +Ya direction. Conversely, when the fourth roller 48D rotates counterclockwise, the transport belt 40 also rotates counterclockwise, and the medium P adsorbed on the transport belt 40 is transported in the −Ya direction.

The transport belt 40 has a plurality of suction holes (not shown) formed therein, and a suction fan (not shown) generates a negative pressure in the suction holes, whereby the medium P is adsorbed on the belt surface of the transport belt 40.

The transport belt 40 adsorbs the medium P transferred from the second transport roller pair 33 (see FIG. 1) to the transport belt 40 and transports the medium P in the +Ya direction. When the end of the medium P in the −Ya direction, that is, the rear end, is transported to a predetermined position, the transport belt 40 transports the medium P in the −Ya direction. At this time, a separation member (not shown) separates the medium P from the transport belt 40, whereby the medium P falls onto the first tray 35 and is mounted. The suction of the medium P by the transport belt 40 is not limited to the suction adsorption type, but may be an electrostatic attraction type.

The first tray 35 is provided with a support portion 39. The rear end of the medium P that has fallen on a first medium receiving surface 35*a* of the first tray 35 comes into contact with a rear end aligning portion 38, and the position thereof is aligned. When a plurality of media P are mounted on the first tray 35, the rear end is aligned by the rear end aligning portion 38.

Figure 4:
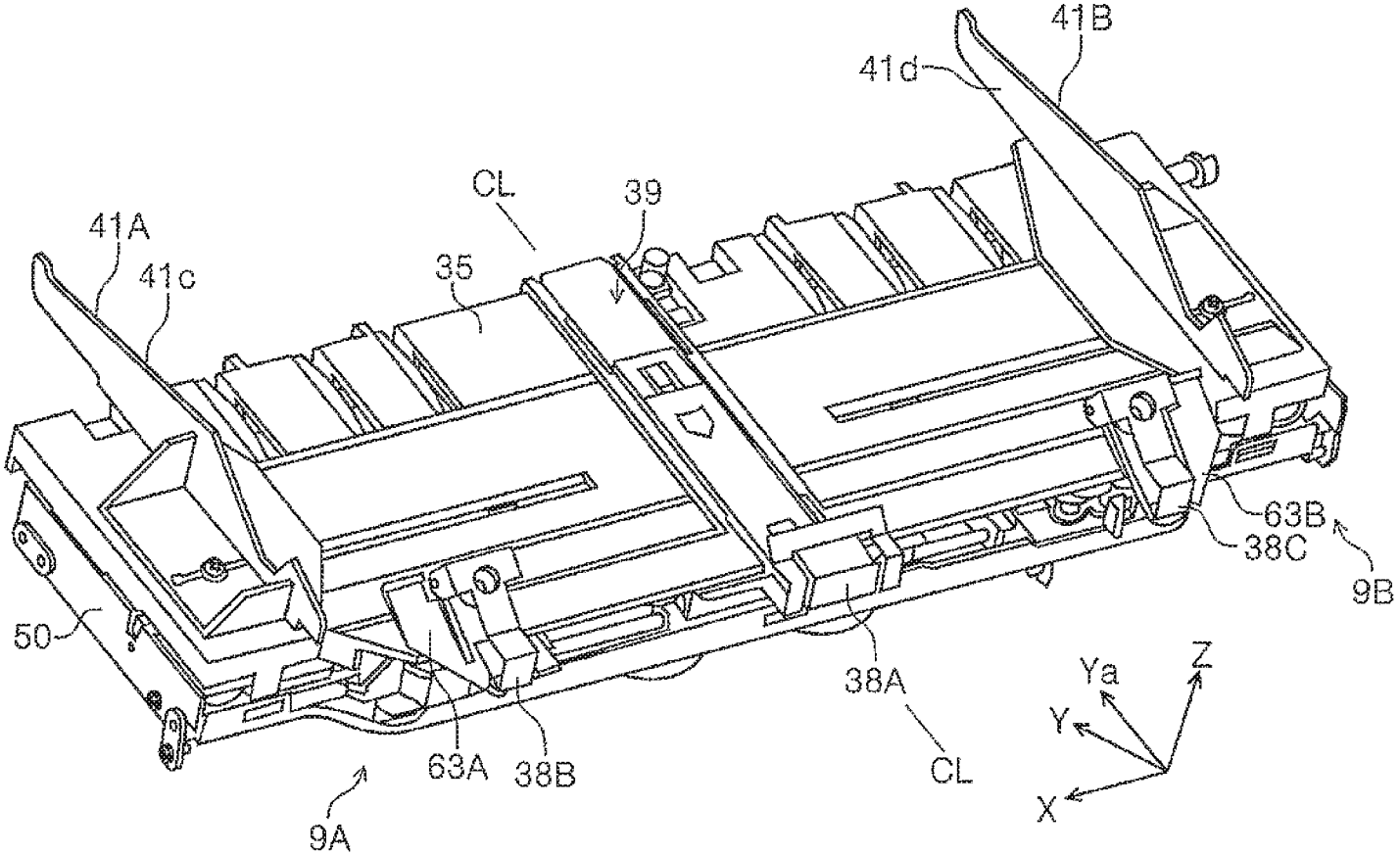
FIG. 4 is a perspective view showing the appearance of a medium aligning device.

As shown in FIG. 4, a plurality of rear end aligning portions 38 are provided in the X-axis direction. The rear end aligning portion 38A includes a rear end aligning portion 38A at the center in the X-axis direction, a rear end aligning portion 38B in the +X direction with respect to the rear end aligning portion 38A, and a rear end aligning portion 38C in the −X direction with respect to the rear end aligning portion 38A. The center rear end aligning portion 38A is provided on the support portion 39. The rear end aligning portion 38B constitutes the medium aligning device 9A, and the rear end aligning portion 38C constitutes the medium aligning device 9B.

In the first tray 35, as shown in FIG. 4, a side end aligning portion 41A is provided in the +X direction of the support portion 39 in the X-axis direction, and a side end aligning portion 41B is provided in the −X direction of the support portion 39. The side end aligning portions 41A and 41B abut on the end of the medium P in the X-axis direction mounted on the first tray 35, and the end in the X-axis direction is aligned. Hereinafter, the end of the medium P in the X-axis direction may be simply referred to as "side end". The side end aligning portion 41A constitutes a medium aligning device 9A, and the side end aligning portion 41B constitutes a medium aligning device 9B.

Figure 3:
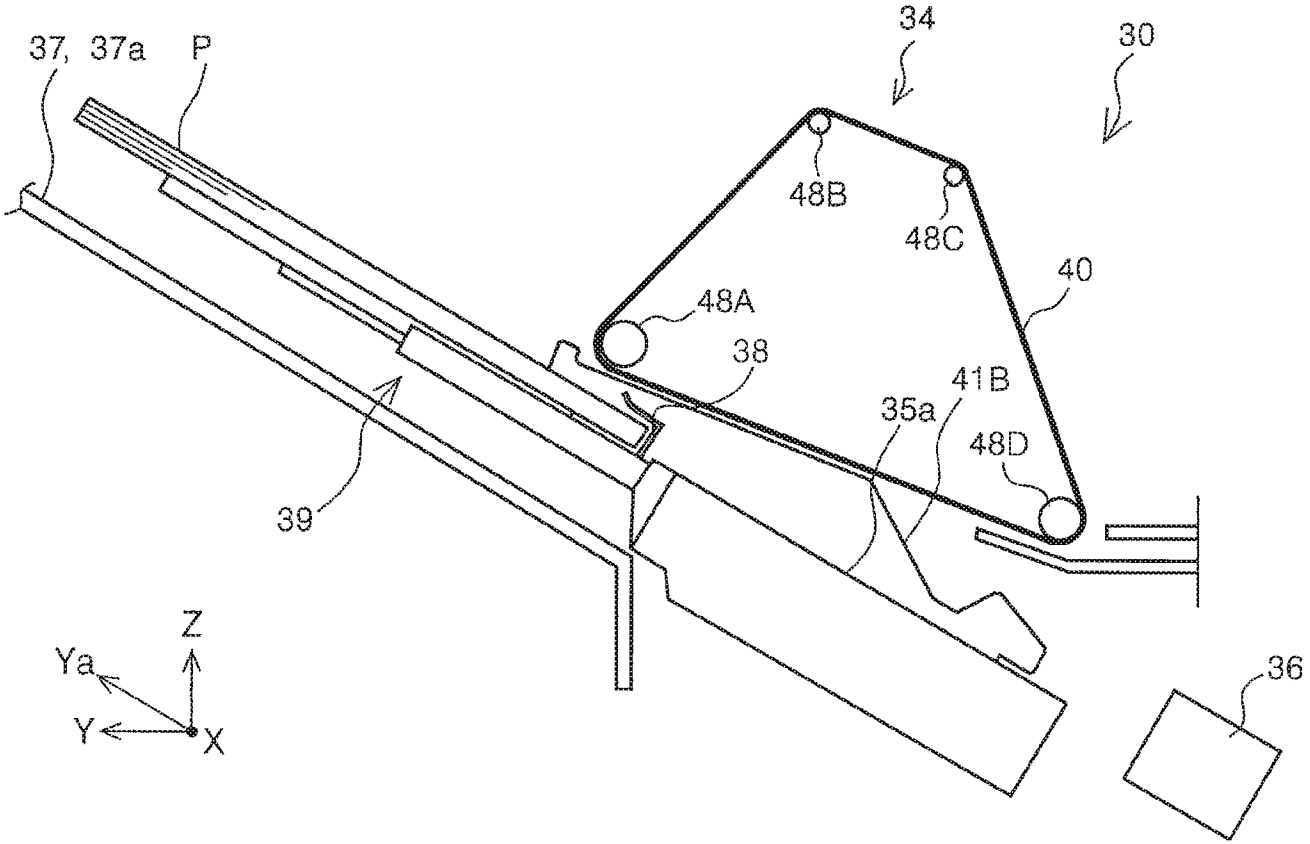
FIG. 3 is a side view of the medium processing apparatus.

In the medium discharge device 30 shown in FIG. 2, processing such as a stapling processing is performed on one or a plurality of media P mounted on the first tray 35 with the rear end of the medium P aligned with the rear end aligning portion 38 by a processing portion 36 provided in the −Ya direction on the first tray 35. In the present embodiment, the processing portion 36 is configured to perform a stapling processing of hitting a binding staple at the rear end of the medium P. The medium P processed by the processing portion 36 is moved to the upper portion of the second tray 37 by the support portion 39 as shown in a change from FIG. 2 to FIG. 3, and then the support portion 39 returns to the original position and falls onto the second tray 37.

Hereinafter, the medium aligning devices 9A and 9B provided on the first tray 35 will be described with reference to FIG. 4 and subsequent drawings. The medium aligning device 9A is provided in the +X direction with respect to the support portion 39, and the medium aligning device 9B is provided in the −X direction with respect to the support portion 39. The support portion 39 is provided at the center position of the medium P in the X-axis direction. Hereinafter, the center position of the medium P in the X-axis direction, that is, the width direction, may be referred to as "width center position CL". Hereinafter, the X-axis direction may be simply referred to as "width direction".

The first tray 35 has an accommodation frame 50 on the lower side, and the accommodation frame 50 is provided with the medium aligning devices 9A and 9B.

Figure 5:
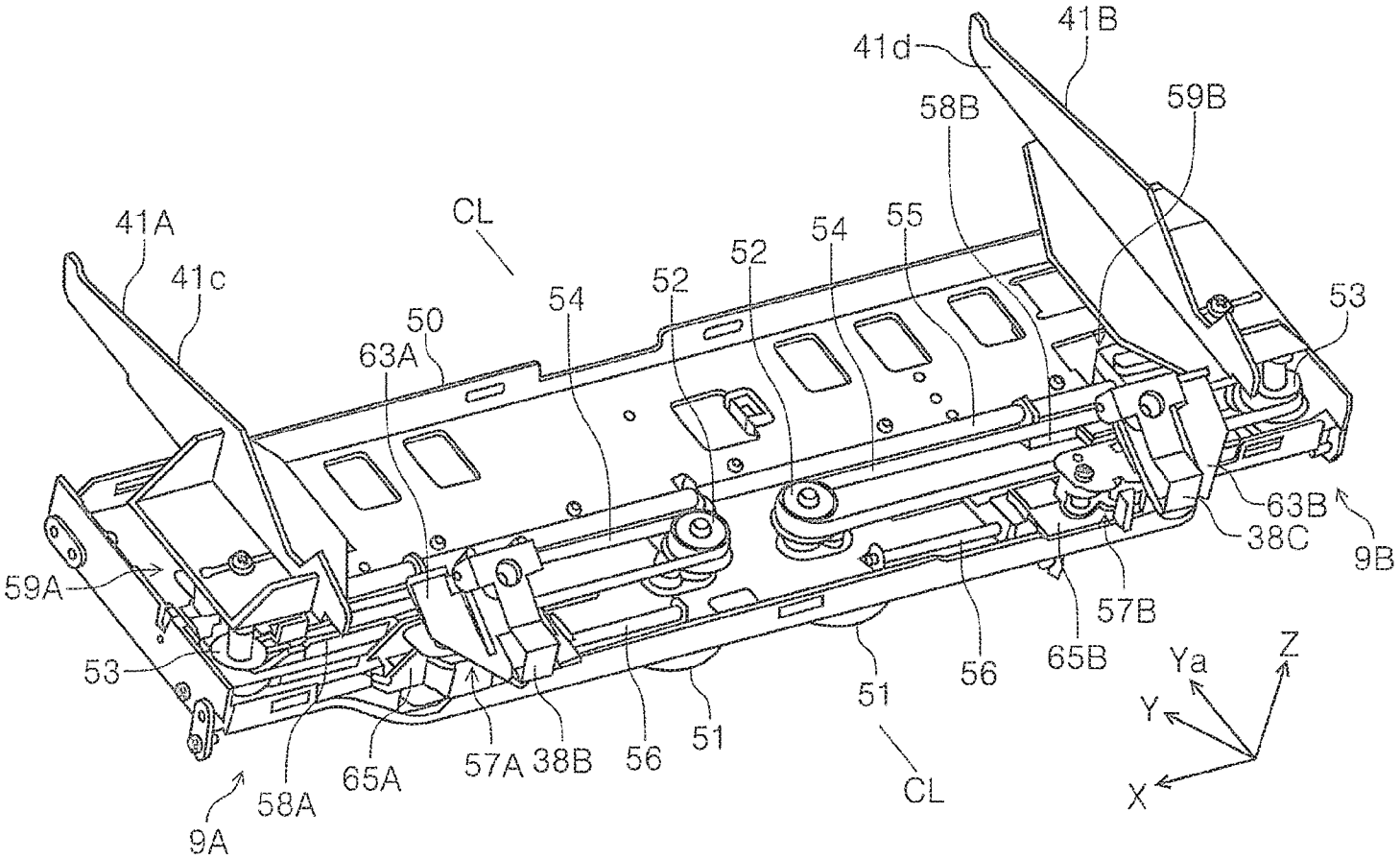
FIG. 5 is a perspective view showing the internal structure of the medium aligning device.

In FIG. 5, the medium aligning device 9A includes a motor 51, and has a drive pulley 52 driven to rotate by the motor 51. A driven pulley 53 is provided at a position away from the drive pulley 52 in the X-axis direction from the width center position CL, and a drive belt 54 is wound around the drive pulley 52 and the driven pulley 53. A side end aligning unit 59A, which will be described later, is fixed to a part of the drive belt 54. When the motor 51 rotates to drive the drive belt 54, the side end aligning unit 59A moves in the width direction while being guided by a first guide shaft 55. The above-described side end aligning portion 41A is attached to the side end aligning unit 59A.

The medium aligning device 9B also has a similar configuration. In FIG. 5, reference numeral 59B denotes a side end aligning unit corresponding to the side end aligning unit 59A. The above-described side end aligning portion 41B is attached to the side end aligning unit 59B.

Hereinafter, a more detailed description will be given with reference to FIG. 5 and subsequent drawings. The medium aligning device 9A and the medium aligning device 9B are symmetrically arranged with respect to the width center position CL, and have a symmetric structure with respect to the width center position CL. Since the basic structure and operation are the same, a specific structure of the medium aligning device will be described below using the medium aligning device 9A provided in the +X direction with respect to the support portion 39 as an example. Differences between the medium aligning device 9A and the medium aligning device 9B will be described later.

Further, hereinafter, in an area on one side end side from the width center position CL, a direction from the width center position CL to the side end of the medium P is referred to as an outward direction Ua, and a direction from the side end of the medium P to the width center position CL is referred to as an inward direction Ub. For example, in the medium aligning device 9A provided in the +X direction with respect to the width center position CL, the +X direction is the outward direction Ua, and the −X direction is the inward direction Ub. Similarly, in the medium aligning device 9B provided in the −X direction with respect to the width center position CL, the −X direction is the outward direction Ua, and the +X direction is the inward direction Ub.

Figure 6:
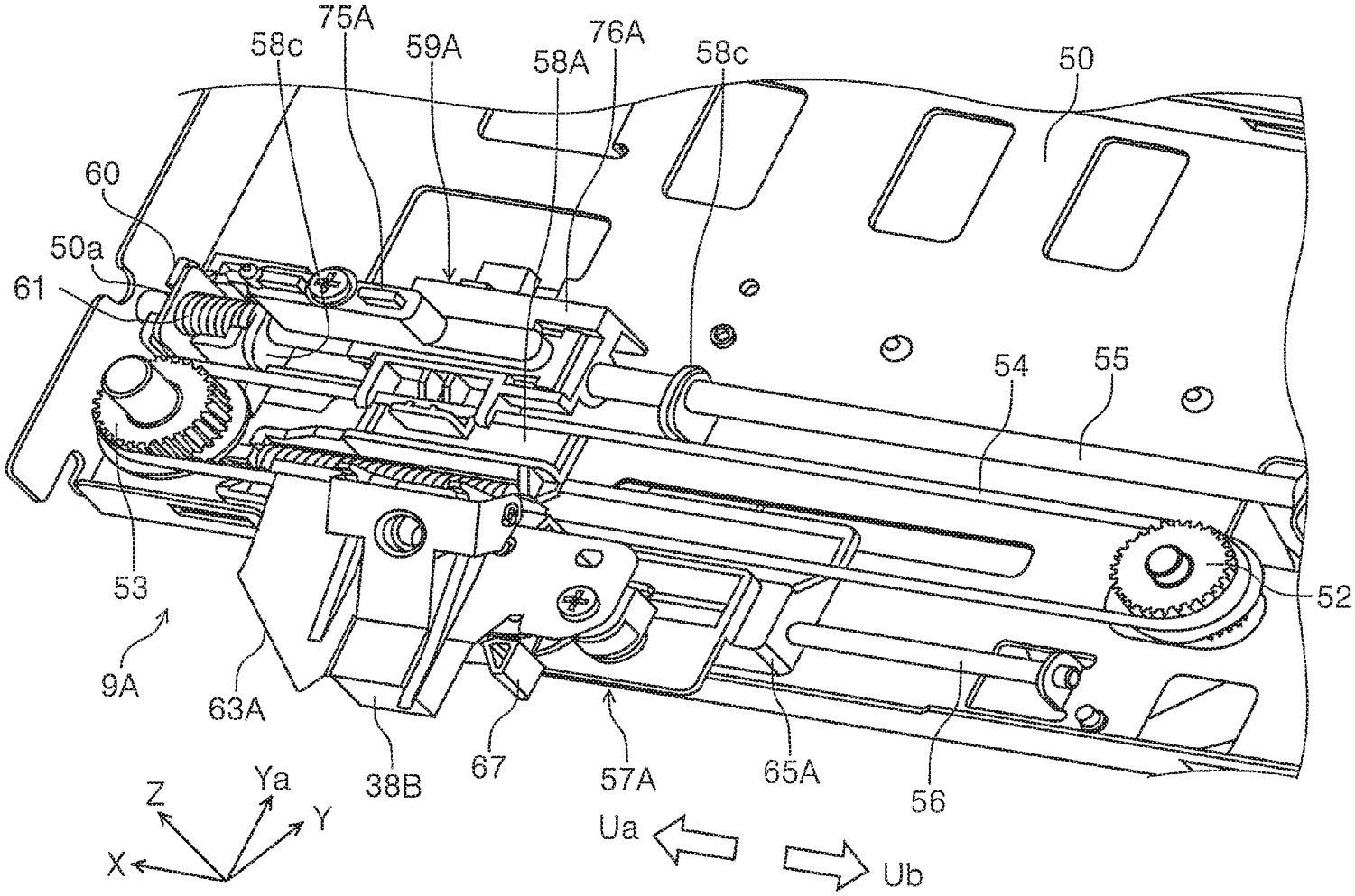
FIG. 6 is an enlarged perspective view of the medium aligning device.
Figure 7:
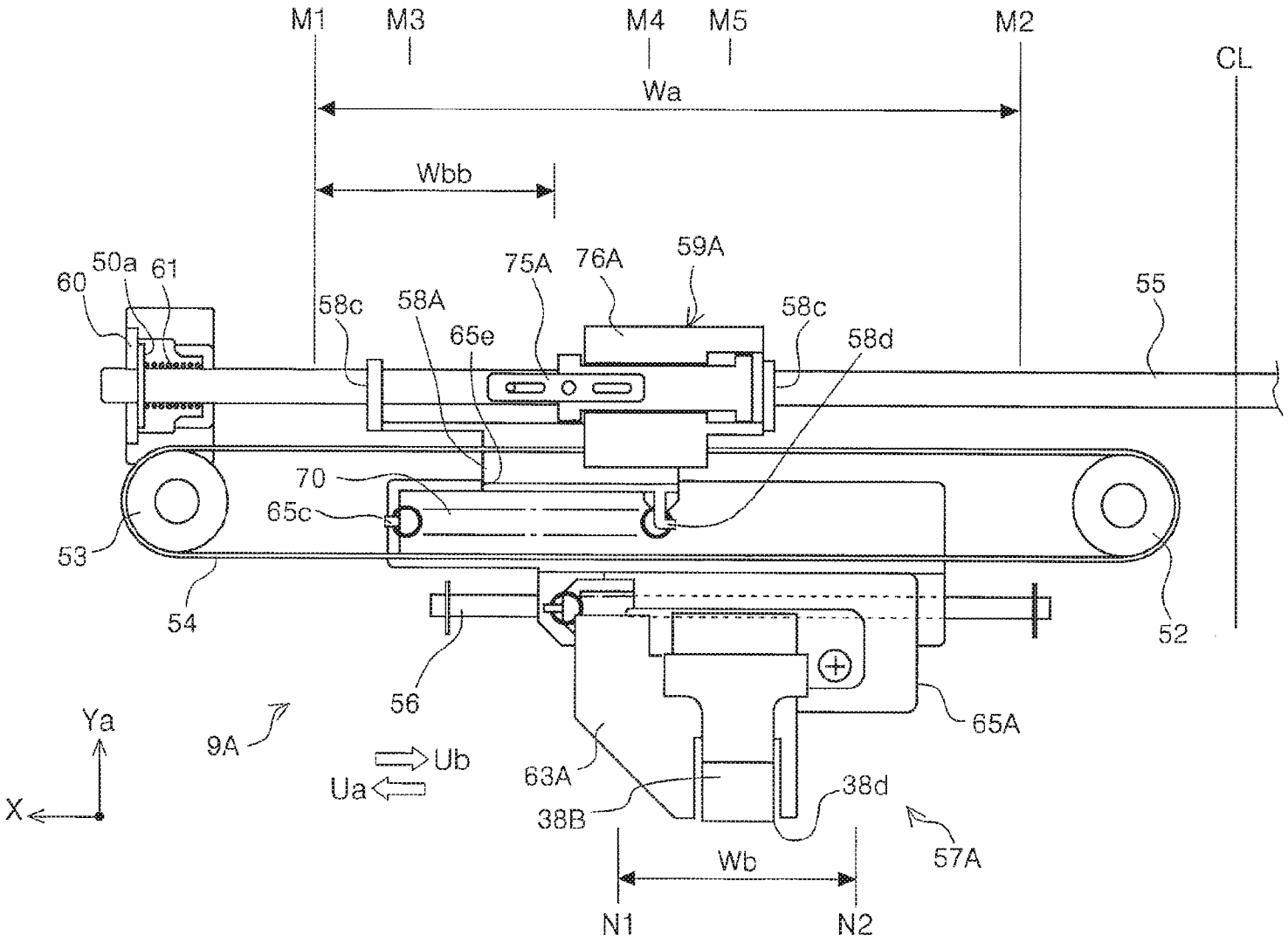
FIG. 7 is a plan view of the medium aligning device.

FIGS. 6 and 7 show a state in which the side end aligning portion 41A is removed from the side end aligning unit 59A. The side end aligning unit 59A includes an attachment portion 75A for attaching the side end aligning portion 41A, and a slider 76A. The first guide shaft 55 penetrates through the slider 76A, whereby the slider 76A is guided in the width direction along the first guide shaft 55.

The first guide shaft 55 extends from the +X direction end to the −X direction end of the accommodation frame 50 as shown in FIG. 5, is parallel to the X-axis direction, that is, the width direction, and is an axis commonly used by the medium aligning devices 9A and 9B. In the present embodiment, the length of the first guide shaft 55 in the width direction is set to be longer than the length of the A4 size medium in the longitudinal direction, specifically, 297 mm, for example, about 410 mm.

In FIGS. 6 and 7, the shaft end of the first guide shaft 55 is supported by a shaft support portion 50*a*, and the shaft support portion 50*a* is provided with a shaft slider 60 slidable slightly in the X-axis direction with respect to the first guide shaft 55 and a coil spring 61 for pressing the shaft slider 60 in the inward direction Ub. The movement range of the shaft slider 60 in the X-axis direction is restricted by the shaft support portion 50*a*.

When the side end aligning unit 59A moves to the end in the outward direction Ua, of two shaft penetration portions 58*c* of an intermediate slider 58A described later, the shaft penetration portion 58*c* in the outward direction Ua abuts on the shaft slider 60, and the shaft slider 60 is slightly displaced in the outward direction Ua. However, when the driving force of the motor 51 (see FIG. 5) for driving the side end aligning unit 59A is cut off, the shaft slider 60 is returned in the inward direction Ub by the spring force of the coil spring 61, and the side end aligning unit 59A is also returned in the inward direction Ub. Therefore, the position of the side end aligning unit 59A at this time is referred to as a movement limit position of the side end aligning unit 59A in the outward direction Ua for convenience.

Subsequently, the attachment portion 75A is provided so as to be displaceable by a small amount, for example, about 4 to 5 mm in the width direction with respect to the slider 76A, and is provided in a state of being pressed in the inward direction Ub by a spring (not shown). When the attachment portion 75A is pressed in the outward direction Ua, the attachment portion 75A can be slightly displaced in the outward direction Ua against the pressing force of the spring.

In the present embodiment, when aligning the side end of the medium P, in a state where the side end aligning portion 41A constituting one medium aligning device 9A of the two medium aligning devices is stopped, an operation of hitting the side end aligning portion 41B constituting the other medium aligning device 9B against the side end of the medium P is performed. Therefore, in the medium aligning device 9A, the attachment portion 75A, that is, the side end aligning portion 41A can be slightly displaced in the width direction as described above, so that even if the size of the medium P varies, it can be absorbed.

For this reason, in the side end aligning unit 59B (see FIG. 14) of the medium aligning device 9B provided in the −X direction with respect to the width center position CL, an attachment portion 75B for attaching the side end aligning portion 41B and a slider 76B penetrating through the first guide shaft 55 are provided integrally, not as separate members. This is a difference between the medium aligning device 9A and the medium aligning device 9B.

Referring back to FIGS. 6 and 7, the medium aligning device 9A includes the intermediate slider 58A as a transmission portion that transmits the movement of the side end aligning unit 59A in the width direction to the rear end aligning unit 57A. The intermediate slider 58A has shaft penetration portions 58*c*, 58*c* so as to interpose the side end aligning unit 59A therebetween from both sides in the width direction. The intermediate slider 58A is slidable in the width direction by being guided by the first guide shaft 55 when the first guide shaft 55 penetrates through the shaft penetration portions 58*c*, 58*c*.

A play is provided in the width direction between the shaft penetration portions 58*c*, 58*c* and the side end aligning unit 59A, and the side end aligning unit 59A can be displaced in the width direction between the shaft penetration portions 58*c*, 58*c*. This play is set to about 30 mm in the present embodiment. The function played by this play will be described later in detail.

Next, the rear end aligning unit 57A is engaged with the intermediate slider 58A. The rear end aligning unit 57A is formed by assembling various members on a base member 65A, and the rear end aligning portion 38B is attached as one of them. A second guide shaft 56 penetrates through the base member 65A. The second guide shaft 56 is an axis that is parallel to the X-axis direction, that is, the width direction. The second guide shaft 56 is a shaft whose length in the width direction is shorter than the first guide shaft 55 described above. In the present embodiment, the length of the shaft in the area where the base member 65A can move is about 105 mm.

Figure 8:
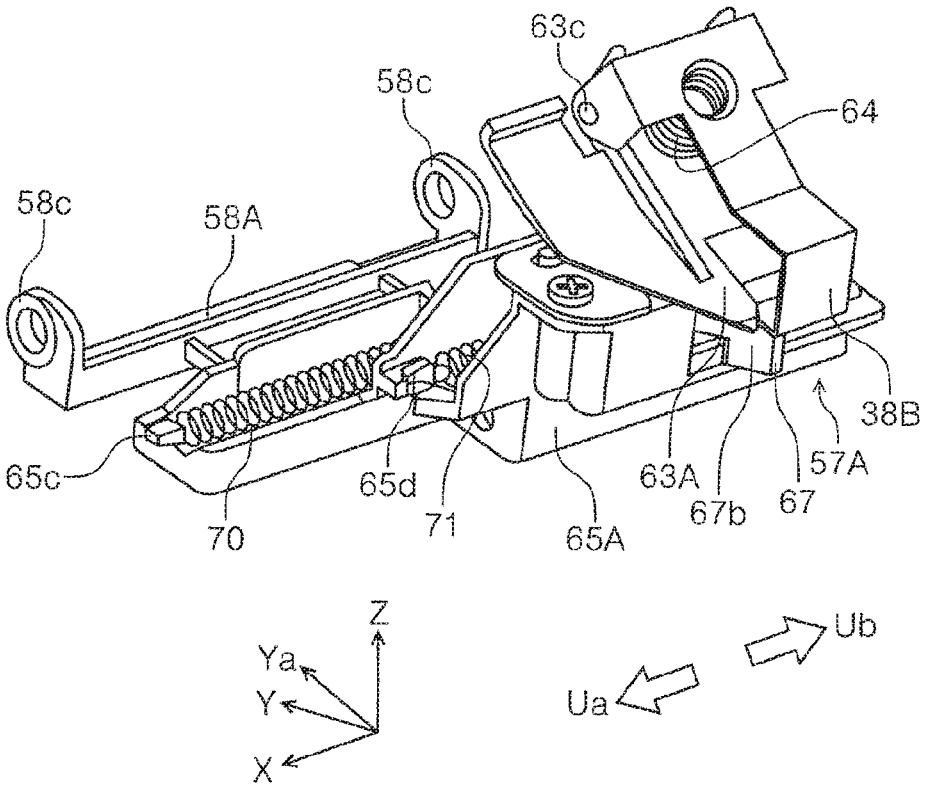
FIG. 8 is a perspective view of a rear end aligning unit and an intermediate slider.
Figure 9:
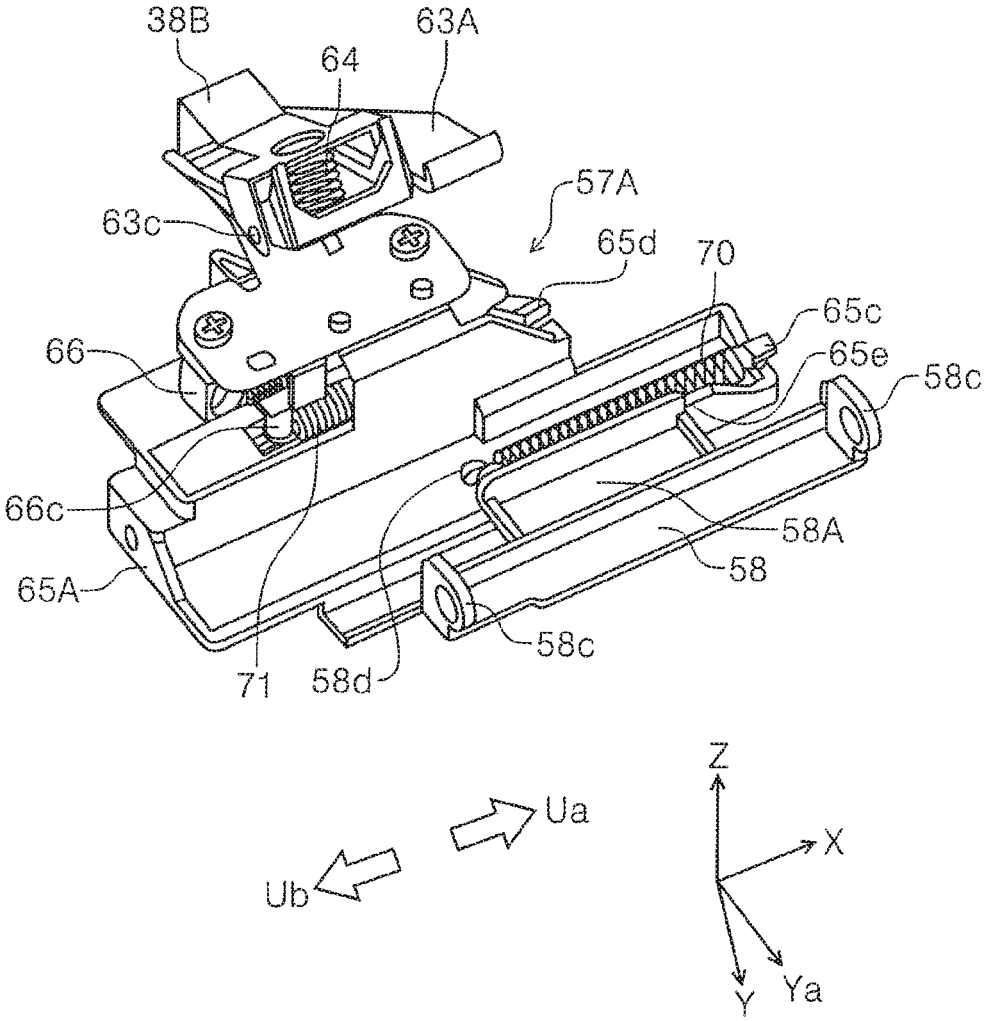
FIG. 9 is a perspective view of the rear end aligning unit and the intermediate slider.
Figure 10:
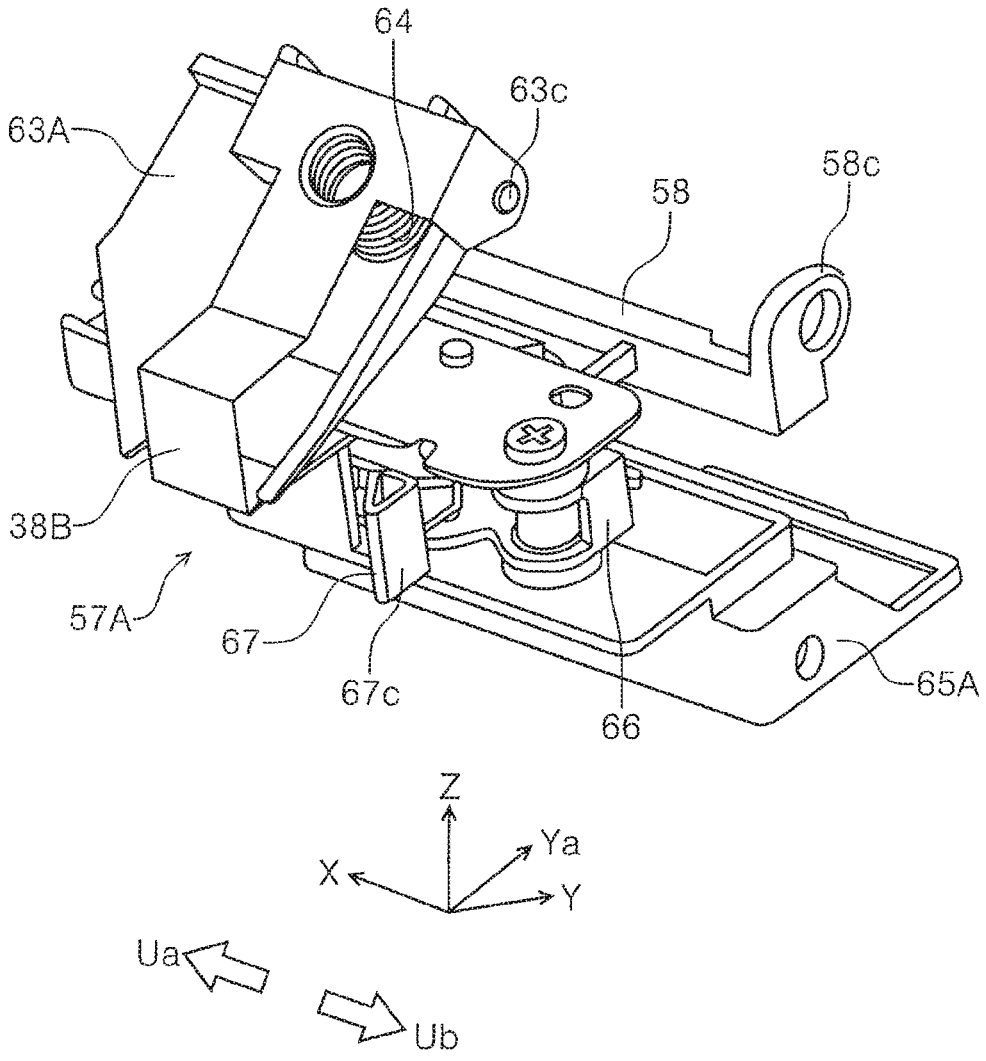
FIG. 10 is a perspective view of the rear end aligning unit and the intermediate slider.

The rear end aligning portion 38B is attached to the base member 65A, and the rear end aligning portion 38B is provided with a pressing member 63A as shown in FIGS. 8 to 10. The pressing member 63A is supported so as to be swingable about the rotation shaft 63*c* and is pressed downward by a compression coil spring 64. The pressing member 63A suppresses the bundle of the media P, whose rear end has been aligned by the rear end aligning portion 38B, by pressing down the bundle of the media P that is abutting on the rear end aligning portion 38B.

As shown in FIGS. 7 and 9, a spring hook 58*d* is formed at the intermediate slider 58A, a spring hook 65*c* is formed at the base member 65A, and a return spring 70 is hung on these two spring hooks. The return spring 70 is a tension coil spring. When the rear end aligning unit 57A moves in the outward direction Ua in a state in which the intermediate slider 58A is stopped, the return spring 70 is extended, and the spring force causes the rear end aligning unit 57A to move in the inward direction Ub.

When the side end aligning unit 59A moves from the end in the outward direction Ua toward the inward direction Ub, when the side end aligning unit 59A is within a range Wbb in FIG. 7, the intermediate slider 58A abuts on an abutting portion 65*e* formed at the base member 65A, and the return spring 70 has the shortest spring length. The positions indicated by reference numerals M1 to M5 in FIG. 7 will be described later in detail, but are shown with reference to a surface where the side end aligning portion 41A comes into contact with the side end of the medium P.

The length of the range Wbb in FIG. 7 is the same as the length of the movable range Wb of the rear end aligning unit 57A. Therefore, when the side end aligning unit 59A moves in the inward direction Ub outside the range Wbb in FIG. 7, since the rear end aligning unit 57A cannot move in the inward direction Ub, the intermediate slider 58A separates from the abutting portion 65*e*, and the return spring 70 expands (for example, see the medium aligning device 9A in FIG. 17).

Further, even in a state in which the side end aligning unit 59A is within the range Wbb, the processing portion 36 presses the rear end aligning unit 57A in the outward direction Ua, so that the abutting portion 65*e* is separated from the intermediate slider 58A, and the return spring 70 starts to expand.

Figure 11:
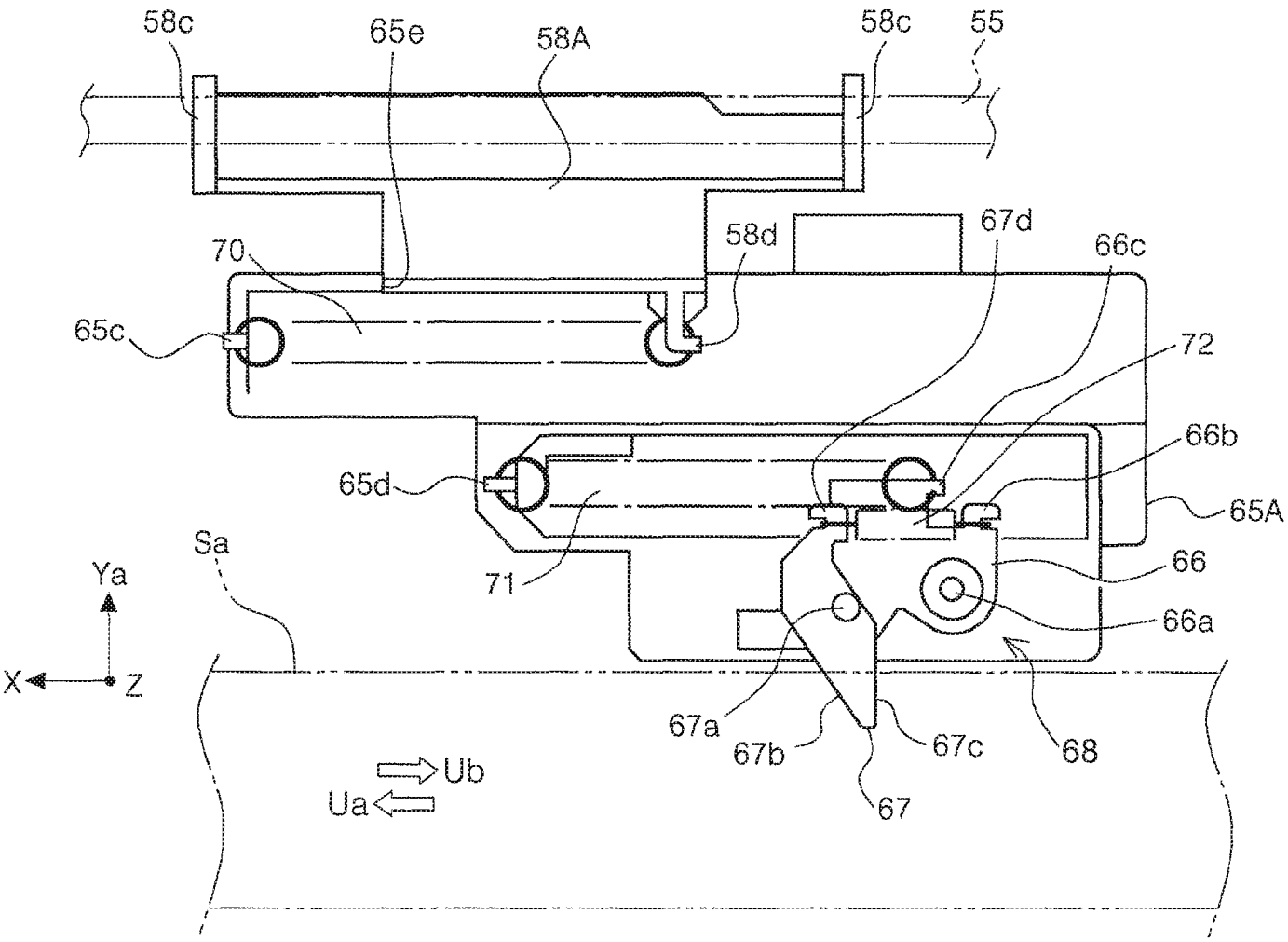
FIG. 11 is a sectional view showing the internal structure of the rear end aligning unit.
Figure 12:
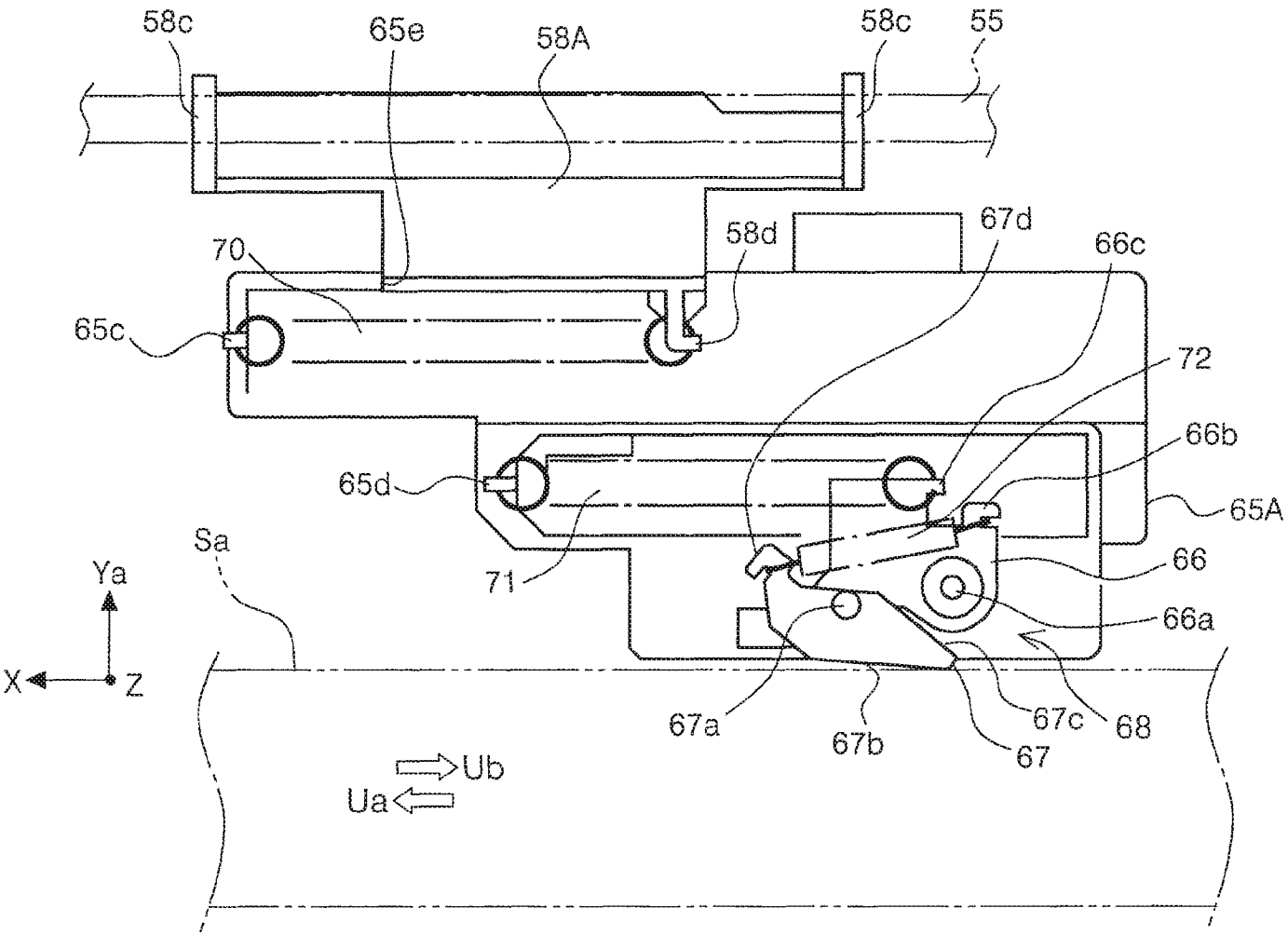
FIG. 12 is a sectional view showing the internal structure of the rear end aligning unit.
Figure 13:
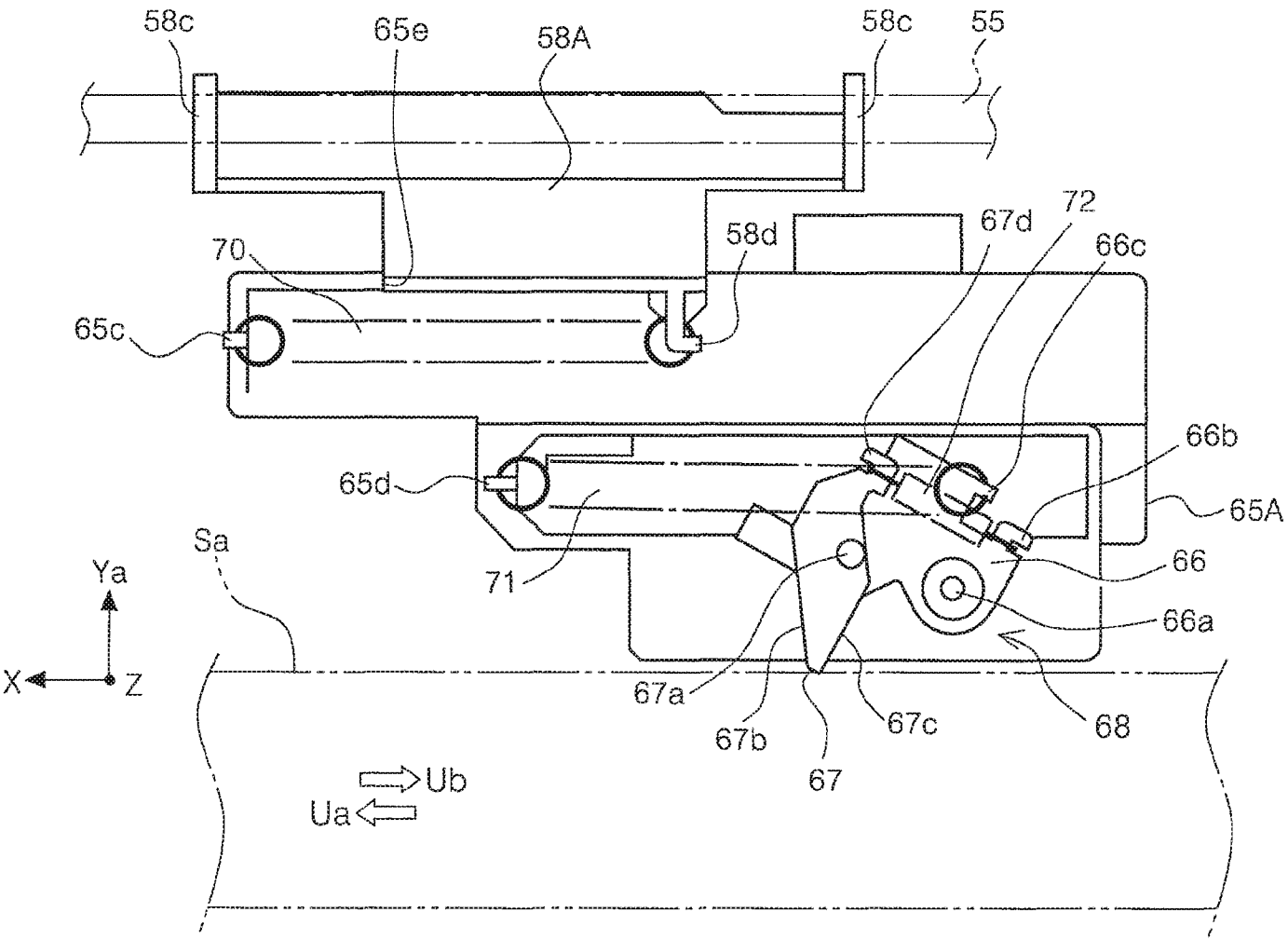
FIG. 13 is a sectional view showing the internal structure of the rear end aligning unit.

Next, below the rear end aligning portion 38B of the base member 65A, an advance and retreat restricting section 68 is provided as shown in FIGS. 11 to 13. The advance and retreat restricting section 68 includes an abutting portion 67, a rotation member 66, a first pressing spring 72, and a second pressing spring 71.

The abutting portion 67 is capable of moving forward and backward with respect to the movement area Sa of the processing portion 36, and abuts on the processing portion 36 in a state where it has advanced to the movement area Sa of the processing portion 36.

The advance and retreat restricting section 68 retracts the abutting portion 67 from the movement area Sa of the processing portion 36 when the processing portion 36 abuts on the abutting portion 67 while moving in the inward direction Ub. As a result, when the processing portion 36 moves in the inward direction Ub, the rear end aligning unit 57A can maintain the position without moving.

In addition, when the processing portion 36 abuts on the abutting portion 67 while moving in the outward direction Ua, the advance and retreat restricting section 68 maintains the abutting portion 67 at the advanced position. Accordingly, when the processing portion 36 moves in the outward direction Ua, the processing portion 36 can press the rear end aligning unit 57A in the outward direction Ua, and move the rear end aligning unit 57A in the outward direction Ua.

Hereinafter, the configuration of the advance and retreat restricting section 68 that realizes the above function will be described in detail. The abutting portion 67 is provided so as to advance and retreat with respect to the movement area Sa of the processing portion 36 by rotating about a rotation shaft 67*a*. The rotation shaft 67*a* of the abutting portion 67 is provided on the rotation member 66 rotatable about a rotation shaft 66*a*, that is, the abutting portion 67 is rotatably supported by the rotation member 66. The abutting portion 67 advances and retreats with respect to the movement area Sa of the processing portion 36 by rotating with respect to the rotation member 66. FIG. 11 shows a state in which the abutting portion 67 has advanced into the movement area Sa of the processing portion 36. FIG. 12 shows a state in which the abutting portion 67 is retracted from the movement area Sa of the processing portion 36 as the abutting portion 67 rotates with respect to the rotation member 66 from the state of FIG. 11.

A first spring 72 that applies a spring force to the abutting portion 67 in a direction in which the abutting portion 67 advances into the movement area Sa of the processing portion 36 is provided between the abutting portion 67 and the rotation member 66. Reference numeral 66*b* denotes a spring hook for hanging the first spring 72 on the rotation member 66, and reference numeral 67*d* denotes a spring hook for hooking the first spring 72 on the abutting portion 67.

The first spring 72 applies a spring force to rotate the abutting portion 67 in the clockwise direction in FIGS. 11 to 13, but the abutting portion 67 maintains the state of FIG. 11 in a state where the abutting portion 67 is not engaged with the processing portion 36 by a stopper (not shown).

As described above, the abutting portion 67 is supported by the rotation member 66 so as to be rotatable with respect to the rotation member 66 when the processing portion 36 moving in the inward direction Ub abuts on the processing portion 36, and so that it cannot rotate with respect to the rotation member 66 when the processing portion 36 moving in the outward direction Ua abuts on the rotation member 66.

When the processing portion 36 moving in the inward direction Ub abuts on the abutting portion 67 in the advanced state, the processing portion 36 abuts on a forward contact surface 67*b*. When the abutting portion 67 is in the advanced state as shown in FIG. 11, the forward contact surface 67*b* forms an inclined surface with respect to the moving direction of the processing portion 36, that is, the width direction. Further, when the processing portion 36 that moves in the outward direction Ua abuts on the abutting portion 67 in the advanced state, the processing portion 36 abuts on a reverse contact surface 67*c*. As shown in FIG. 11, the reverse contact surface 67*c* forms a surface orthogonal to the moving direction of the processing portion 36, that is, the width direction.

Next, a second spring 71 is provided between the base member 65A and the rotation member 66 to apply a spring force to the rotation member 66 in a direction in which the abutting portion 67 projects into the movement area Sa of the processing portion 36. Reference numeral 66*c* denotes a spring hook for hanging the second spring 71 on the rotation member 66, and reference numeral 65*d* denotes a spring hook for hanging the second spring 71 on the base member 65A.

The second spring 71 applies a spring force to rotate the rotation member 66 in the counterclockwise direction in FIGS. 11 to 13, but the rotation member 66 maintains the state of FIG. 11 in a state where the abutting portion 67 is not engaged with the processing portion 36 by a stopper (not shown).

The abutting portion 67 supported by the rotation member 66 advances and retreats with respect to the movement area Sa of the processing portion 36 as the rotation member 66 rotates, which will be described later.

With the above configuration, when the processing portion 36 moving in the inward direction Ub abuts on the abutting portion 67, the abutting portion 67 rotates with respect to the rotation member 66 against the spring force of the first spring 72. As a result, the abutting portion 67 is retracted from the movement area Sa of the processing portion 36.

When the processing portion 36 that moves in the outward direction Ua abuts on the abutting portion 67, due to the spring force of the second spring 71, the abutting portion 67 and the rotation member 66 do not rotate together, and the state in which the abutting portion 67 has advanced into the movement area Sa of the processing portion 36 is maintained. Therefore, the rear end aligning unit 57A is moved by the processing portion 36 in the outward direction Ua.

As described above, the rear end aligning unit 57A and the intermediate slider 58A are formed separately and provided so as to be displaceable in the width direction, respectively. The return spring 70 is hung between the rear end aligning unit 57A and the intermediate slider 58A. Therefore, when the processing portion 36 moves in the inward direction Ub after the rear end aligning unit 57A moves in the outward direction Ua by the processing portion 36, the rear end aligning unit 57A returns to the inward direction Ub by the spring force of the return spring 70.

When the processing portion 36 further moves in the outward direction Ua after the rear end aligning unit 57A has moved to the movement limit position in the outward direction Ua by the processing portion 36 moving in the outward direction Ua, as the rotation member 66 rotates against the spring force of the second spring 71, the abutting portion 67 retreats from the movement area Sa of the processing portion 36 as shown in FIG. 13. Thereby, the movement of the processing portion 36 in the outward direction Ua is permitted.

These relationships among the spring force of the return spring 70, the spring force of the first spring 72, and the spring force of the second spring 71 are adjusted so that the above-described functions can be realized.

Figure 14:
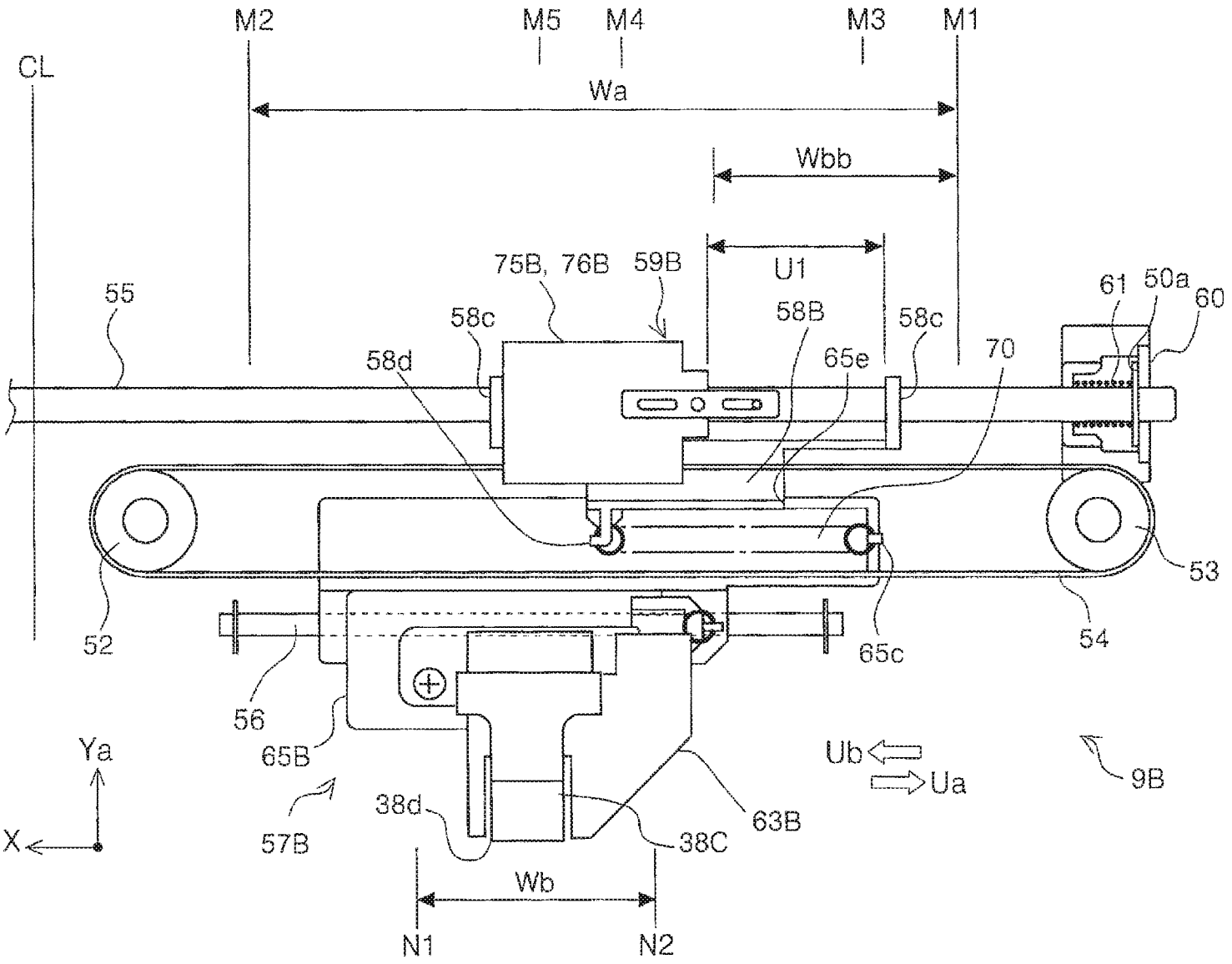
FIG. 14 is a plan view of the medium aligning device.

The configuration of the medium aligning device 9A described above is similarly provided in the medium aligning device 9B. In FIG. 14 showing the configuration of the medium aligning device 9B, reference numeral 58B is an intermediate slider corresponding to the above-described intermediate slider 58A, and reference numeral 65B is a base member corresponding to the above-described base member 65A. Reference numeral 63B is a pressing member corresponding to the pressing member 63A described above. Of course, the medium aligning device 9B is also provided with the abutting portion 67 and the advance and retreat restricting section 68 described above.

Subsequently, with reference to FIG. 15, the movable range of the processing portion 36, the side end aligning portion 41A provided in the side end aligning unit 59A (see FIG. 5), the side end aligning portion 41B provided in the side end aligning unit 59B (see FIG. 5), and the rear end aligning portions 38B and 38C will be described.

Figure 15:
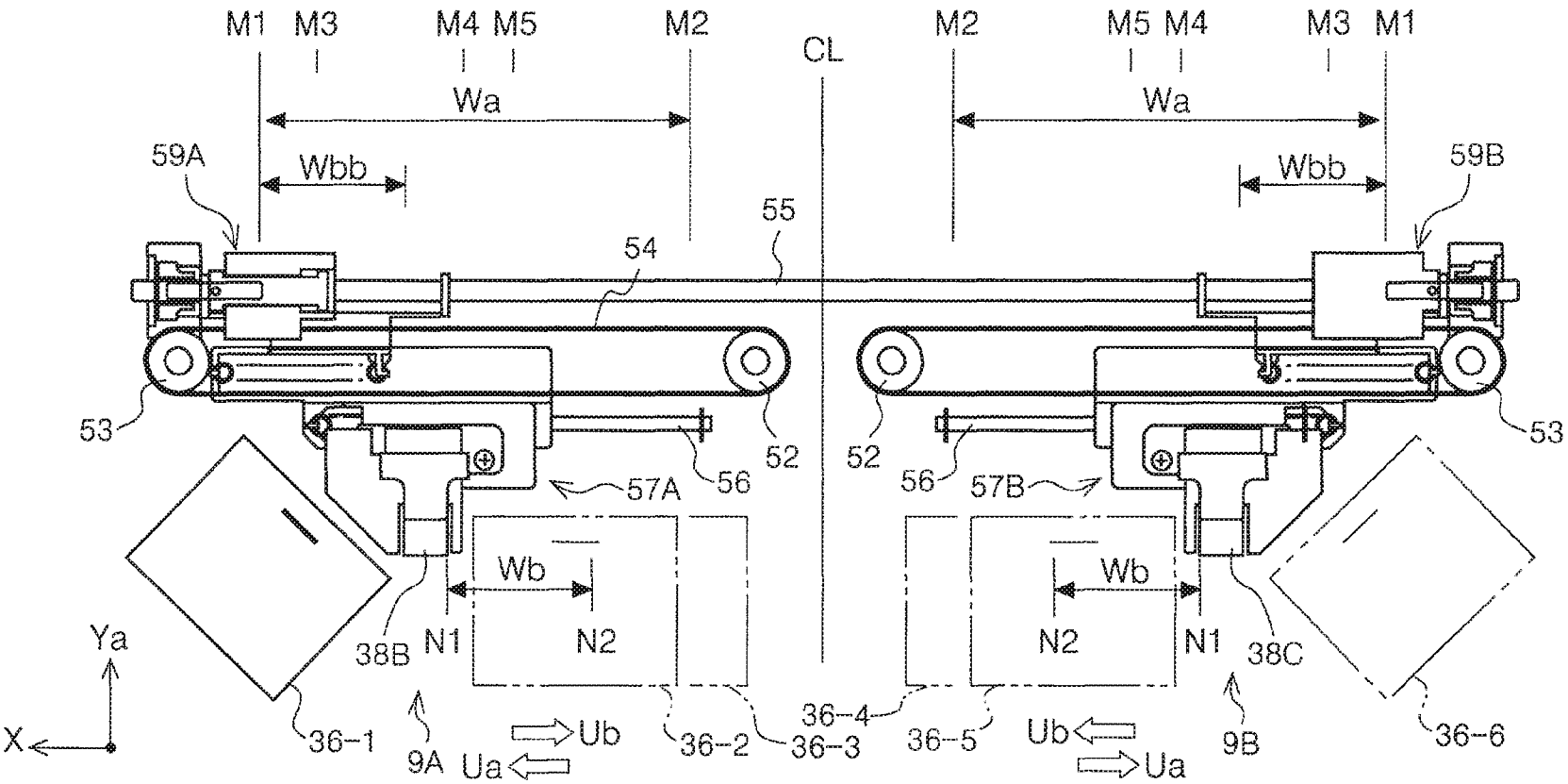
FIG. 15 is a plan view of the medium aligning device.

In FIG. 15, a position M1 is a movement limit position of the side end aligning portions 41A and 41B in the outward direction Ua, and a position M2 is a movement limit position of the side end aligning portions 41A and 41B in the inward direction Ub. The movement limit position M1 in the outward direction Ua and the movement limit position M2 in the inward direction Ub of the side end aligning portions 41A and 41B shown in FIG. 15 are shown based on the position of the surface comes into contact with the side end of the medium P. The surface where the side end aligning portion 41A comes into contact with the side end of the medium P is indicated by reference numeral 41*c* in FIGS. 4 and 5, and the surface where the side end aligning portion 41B comes into contact with the side end of the medium P is indicated by reference numeral 41*d* in FIGS. 4 and 5.

The side end aligning portions 41A and 41B can move within the movable range Wa between the movement limit position M1 in the outward direction Ua and the movement limit position M2 in the inward direction Ub.

The position N1 is a movement limit position of the rear end aligning portions 38B and 38C in the outward direction Ua, and the position N2 is a movement limit position of the rear end aligning portions 38B and 38C in the inward direction Ub. The movement limit position N1 in the outward direction Ua and the movement limit position N2 in the inward direction Ub of the rear end aligning portions 38B and 38C are shown based on the position of a corner 38*d* which is the limit position in the inward direction Ub where the rear end aligning portions 38B and 38C can support the medium P (see FIGS. 7 and 14).

The rear end aligning portions 38B and 38C can move within the movable range Wb between the movement limit position N1 in the outward direction Ua and the movement limit position N2 in the inward direction Ub.

The positions M1 to M5 shown in FIG. 15 are also shown in FIGS. 7, 14, 16, and 17, and the ranges indicated by reference numerals Wa, Wb, and Wbb shown in FIG. 15 are also shown in FIGS. 7 and 14.

Next, in FIG. 15, reference numerals 36-1, 36-2, 36-3, 36-4, 36-5, and 36-6 indicate processing positions when the processing portion 36 performs processing on the medium P. The processing portion indicated by the solid line and reference numeral 36-1 indicates a state where the processing portion 36 is at the home position. The processing portion 36 can stop at each processing position and bind the medium P with a binding staple by moving in the −X direction from the home position indicated by the reference numeral 36-1. At the processing positions indicated by reference numerals 36-1 and 36-6, the processing portion 36 can hit a binding staple obliquely at a corner of the medium P. The oblique hitting here means hitting the binding staple in a direction intersecting both the X-axis direction and the Y-axis direction. In other processing positions, the processing portion 36 can hit a binding staple parallel to the rear end of the medium P. Here, the parallel hit means hitting the binding staple in a direction parallel to the X-axis direction, that is, the width direction.

As shown in FIG. 15, the movement limit position N1 of the rear end aligning portions 38B and 38C in the outward direction Ua is located inside in the inward direction Ub from the movement limit position M1 of the side end aligning portions 41A and 41B in the outward direction Ua. When the processing portion 36 obliquely hits the binding staple at the corner of the rear end of the medium, the rear end aligning portions 38B and 38C are unlikely to be in the way, and the processing by the processing portion 36 can be performed appropriately.

In addition, since the movement limit position N2 of the rear end aligning portions 38B and 38C in the inward direction Ub is located outside in the outward direction Ua from the movement limit position M2 of the side end aligning portions 41A and 41B in the inward direction Ub, the rear end aligning portions 38B and 38C can be prevented from interfering with the support portion 39 and the rear end aligning portion 38A shown in FIG. 4.

Next, an operation when the side ends of the medium P are aligned by the side end aligning portions 41A and 41B will be described. The side end aligning portions 41A and 41B are displaced to positions corresponding to the medium size by moving in the inward direction Ub from the movement limit position M1 in the outward direction Ua. For example, in FIG. 15, the position M3 is a side end position in the width direction when the longitudinal direction of the A3-size medium is arranged along the Ya-axis direction, the position M4 is a side end position in the width direction when the longitudinal direction of the A4-size medium is arranged along the Ya-axis direction, and the position M5 is a side end position in the width direction when the longitudinal direction of the B5 size medium is arranged along the Ya-axis direction.

In the present embodiment, during the operation of aligning the side ends of the medium P, the side end aligning portion 41A stops at a position corresponding to each medium size, and reciprocates between the position where the side end aligning portion 41B corresponds to each of the above medium size and the position where the side end aligning portion 41B has moved in the outward direction Ua by a predetermined amount to hit and align the side end of the medium P.

Here, for example, FIG. 14 shows a state in which the side end aligning portion 41B has moved from the movement limit position M1 to the position M4 for aligning the side end of the A4 size medium. In this case, since the side end aligning unit 59B moves to the position M4 while pressing the shaft penetration portion 58*c* in the inward direction Ub of the two shaft penetration portions 58*c* of the intermediate slider 58 in inward direction Ub, a play U1 is formed between the shaft penetration portion 58*c* of the outward direction Ua and the side end aligning unit 59B. Therefore, even if the side end aligning unit 59B moves in the outward direction Ua and then moves in the inward direction Ub from this state to perform an operation of hitting the side end of the medium P, the intermediate slider 58 can maintain the same position, and the rear end aligning portion 38C can maintain the same position. That is, when the side end aligning portion 41B performs an operation of hitting the side end of the medium P, the rear end aligning portion 38C can be prevented from following the movement, and the aligning state of the medium P can be suppressed from being disturbed. In addition, it is possible to prevent the rear end aligning portion 38C from rubbing the rear end of the medium P.

Figure 16:
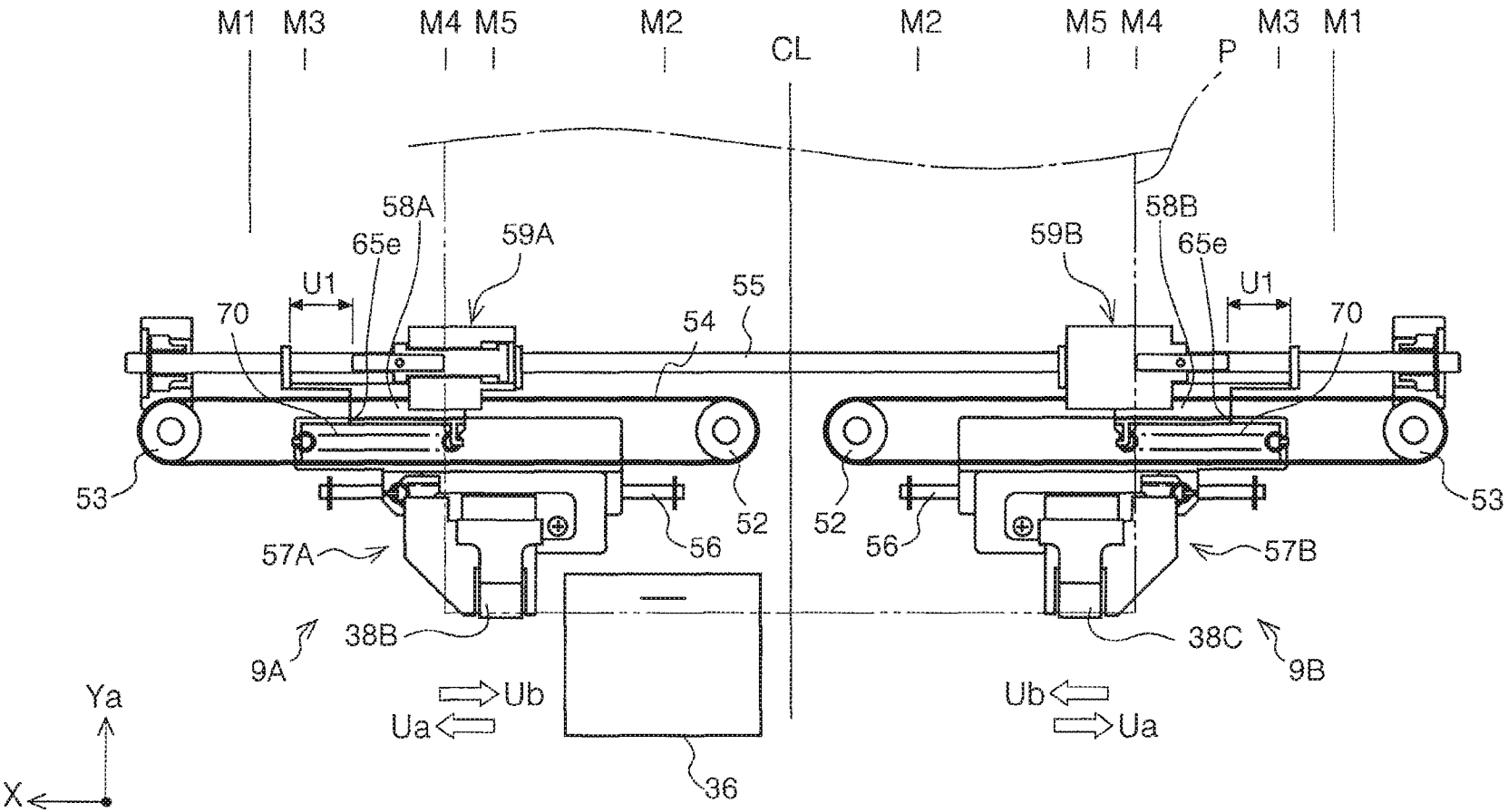
FIG. 16 is a plan view of the medium aligning device.

Also, FIG. 16 shows a case where the side end aligning units 59A and 59B move from the movement limit position M1 in the inward direction Ub similarly to FIG. 14, and shows, as an example, a state where the medium has been moved to the position M4 in FIG. 15 in order to align the side ends of the A4 size medium.

When the processing portion 36 hits the binding staples in parallel at the two rear ends of the A4 size medium, the processing portion 36 hits the binding staples in parallel at the positions 36-3 and 36-4 in FIG. 15. However, at this time, since the rear end aligning portions 38B and 38C are located at positions where they interfere with the processing portion 36, it is necessary for the processing portion 36 to slightly push back the rear end aligning units 57A and 57B in the outward direction Ua.

At this time, as described with reference to FIGS. 11 to 13, when the abutting portion 67 abuts on the processing portion 36 that moves in the outward direction Ua, the state in which the abutting portion 67 has advanced to the movement area Sa of the processing portion 36 is maintained. Therefore, the processing portion 36 can push back the rear end aligning units 57A and 57B in the outward direction Ua, and can hit the binding staple at an appropriate position. The amount by which the processing portion 36 pushes back the rear end aligning units 57A and 57B in the outward direction Ua is set to the extent that the rear end of the medium P does not come off from the rear end aligning portions 38B and 38C.

Figure 17:
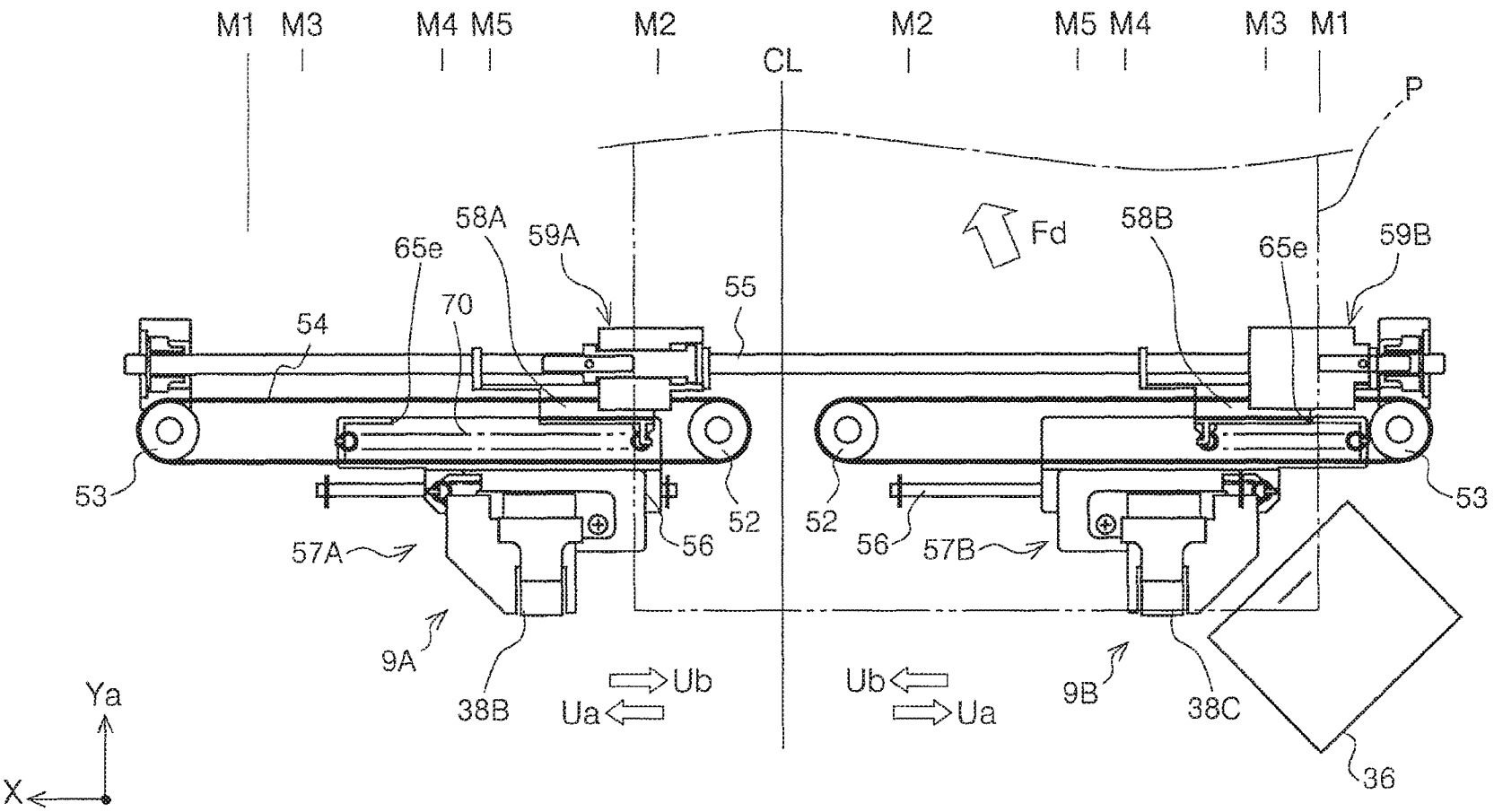
FIG. 17 is a plan view of the medium aligning device.

FIG. 17 shows the state shown in FIG. 16, that is, the state in which the A4 size medium is shifted in the −X direction from the aligning completed state in order to obliquely hit the binding staple at the rear end corner of the A4 size medium. At this time, the side end of the A4 size medium in the −X direction is at the movement limit position M1 shown in FIG. 15. FIG. 17 shows a state in which the processing portion 36 has moved from the position 36-1 to the position 36-6 in FIG. 15. In such a moving process of the processing portion 36, the processing portion 36 needs to first pass through the rear end aligning unit 57A. However, as described with reference to FIGS. 11 to 13, when the abutting portion 67 abuts on the processing portion 36 moving in the inward direction Ub, the abutting portion 67 is retracted from the movement area Sa of the processing portion 36. As a result, the processing portion 36 can pass through the rear end aligning unit 57A.

Next, the processing portion 36 needs to pass through the rear end aligning unit 57B. In this case, as described with reference to FIGS. 11 to 13, when the rear end aligning unit 57A further moves in the outward direction Ua from the state of being located at the movement limit position N1 in the outward direction Ua, since the abutting portion 67 can be retracted from the movement area Sa of the processing portion 36, the processing portion 36 can pass through the rear end aligning unit 57B and can move to the position shown in FIG. 17.

As shown in FIG. 17, the rear end corner of the medium may come off from the rear end aligning portion 38B depending on the medium size. In this case, when the medium P is returned from the shift position shown in FIG. 17 to the original position, that is, the center position shown in FIG. 16, there is a possibility that the rear end corner of the medium that has been separated from the rear end aligning portion 38B may be caught by the rear end aligning portion 38B and damage the medium corner. Accordingly, in such a case, the operation of discharging the medium P by the support portion 39 described with reference to FIG. 3 and the operation of returning the medium P to the center position by the side end aligning portions 41A and 41B (see FIG. 5) are performed simultaneously. Then, the medium P is moved obliquely as shown by the arrow Fd in FIG. 17. Thereby, it is possible to avoid a problem that the rear end corner of the medium that has come off the rear end aligning portion 38B is caught by the rear end aligning portion 38B.

In the example of FIG. 17, the case when the processing portion 36 is moved to the position 36-6 in FIG. 15 and the binding staples are obliquely hit has been described, but the binding staple can also obliquely hit while the processing portion 36 is located at the position 36-1 in FIG. 15, that is, the home position. Similarly to the above, the operation of discharging the medium P in this case is the operation of discharging the medium P by the support portion 39 and the operation of returning the medium P to the center position by the side end aligning portions 41A and 41B (see FIG. 5) simultaneously.

In the above-described embodiment, the present disclosure is applied to both the medium aligning device 9A located in the +X direction with respect to the width center position CL and the medium aligning device 9B located in the −X direction with respect to the width center position CL, but may be applied to only one of them. In particular, it is preferable to apply the present disclosure to a medium aligning device that performs an operation of hitting the side ends of the medium P to align the side ends.

Further, the present disclosure is not limited to the above-described embodiment, and various modifications are possible within the scope of the disclosure described in the claims, and it goes without saying that they are also included in the scope of the present disclosure.

What is claimed is:

1. A medium aligning device comprising:

a stacking tray that stacks a medium discharged by a discharge section that discharges the medium;

a side end aligning device that is movable in a width direction that is a direction intersecting with a medium discharge direction of the discharge section, and positions and aligns a side end in the width direction of the medium stacked on the stacking tray;

a rear end aligning device that is movable in the width direction and positions and aligns a rear end that is an upstream end of the medium stacked on the stacking tray in the discharge direction; and a transmission device that transmits the movement of the side end aligning device in the width direction to the rear end aligning device, wherein a play in the width direction is provided between the side end aligning device and the transmission device, when a direction from a center position of the medium in the width direction toward the side end is an outward direction and a direction from the side end toward the center position is an inward direction, an outward movement limit position of the rear end aligning device in the width direction is located in the inward direction from an outward movement limit position of the side end aligning device, an inward movement limit position of the rear end aligning device in the width direction is located in the outer direction from an inward movement limit position of the side end aligning device, the rear end aligning device is provided with an abutting device that is located upstream of the stacking tray in the discharge direction, that is configured to advance and retreat with respect to a movement area in the width direction of a processing device that performs processing on the medium, and that abuts on the processing device in a state in which the abutting device is advanced into the movement area, and an advance and retreat restricting device that makes the rear end aligning device movable in the outward direction following the processing device by retracting the abutting device from the movement area of the processing device when the processing device abuts on the abutting device while moving in the inward direction and maintaining the abutting device at the advanced position when the processing device abuts on the abutting device while moving in the outward direction.

2. The medium aligning device according to claim 1, wherein the rear end aligning device and the transmission device are configured separately from each other and provided so as to be displaceable in the width direction, respectively, and a return spring is provided between the rear end aligning device and the transmission device, and when the processing device moves in the inward direction after the rear end aligning device moves in the outward direction by the processing device, the rear end aligning device returns to the inward direction by a spring force of the return spring.

3. A medium processing apparatus comprising:

the medium aligning device according to claim 1 that is disposed on both sides with respect to a center position in a width direction that is a direction intersecting with a medium discharge direction; and the processing device.

4. A recording system comprising:

a recording unit including a recording section that performs recording on a medium; and the medium processing apparatus according to claim 3 that performs processing on the medium after recording in the recording unit.

5. A medium aligning device comprising:

a stacking tray that stacks a medium discharged by a discharge section that discharges the medium;

a side end aligning device that is movable in a width direction that is a direction intersecting with a medium discharge direction of the discharge section, and positions and aligns a side end in the width direction of the medium stacked on the stacking tray;

a rear end aligning device that is movable in the width direction and positions and aligns a rear end that is an upstream end of the medium stacked on the stacking tray in the discharge direction; and a transmission device that transmits the movement of the side end aligning device in the width direction to the rear end aligning device, wherein a play in the width direction is provided between the side end aligning device and the transmission device, when a direction from a center position of the medium in the width direction toward the side end is an outward direction and a direction from the side end toward the center position is an inward direction, an outward movement limit position of the rear end aligning device in the width direction is located in the inward direction from an outward movement limit position of the side end aligning device, an inward movement limit position of the rear end aligning device in the width direction is located in the outer direction from an inward movement limit position of the side end aligning device, the rear end aligning device is provided with an abutting device that is located upstream of the stacking tray in the discharge direction, that is configured to advance and retreat with respect to a movement area in the width direction of a processing device that performs processing on the medium, and that abuts on the processing device in a state in which the abutting device is advanced into the movement area, an advance and retreat restricting device that makes the rear end aligning device movable in the outward direction following the processing device by retracting the abutting device from the movement area of the processing device when the processing device abuts on the abutting device while moving in the inward direction and maintaining the abutting device at the advanced position when the processing device abuts on the abutting device while moving in the outward direction, the advance and retreat restricting device includes:

a rotation member configured to rotate and rotatably support the abutting device, a first spring that is provided between the abutting device and the rotation member, and applies a spring force to the abutting device in a direction in which the abutting device advances into the movement area of the processing device, and a second spring that is provided between a base member on which the rear end aligning device is provided and the rotation member, and applies a spring force to the rotation member in a direction in which the abutting device projects into the movement area of the processing device, the abutting device is configured to advance and retreat with respect to the movement area of the processing device by rotating with respect to the rotation member and is configured to advance and retreat with respect to the movement area of the processing device with rotation of the rotation member, the abutting device is supported by the rotation member so as to be rotatable with respect to the rotation member when the processing device moving in the inward direction abuts on the abutting device, and so as to be unrotatable with respect to the rotation member when the processing device moving in the outward direction abuts on the abutting device, when the processing device moving in the inward direction abuts on the abutting device, the abutting device rotates with respect to the rotation member against the spring force of the first spring so that the abutting device is retracted from the movement area of the processing device, and when the processing device moving in the outward direction abuts on the abutting device, the abutting device and the rotation member do not rotate together, and a state in which the abutting device is advanced into the movement area of the processing device is maintained by the spring force of the second spring so that the rear end aligning device moves in the outward direction.

6. The medium aligning device according to claim 5, wherein the advance and retreat restricting device retracts the abutting device to permit the processing device to move in the outward direction when the processing device further moves in the outward direction after the rear end aligning device is moved to outward movement limit position by the processing device moving in the outward direction.

7. The medium aligning device according to claim 6, wherein when the processing device further moves in the outward direction after the rear end aligning device is moved to the outward movement limit position by the processing device moving in the outward direction, the rotation member rotates against the spring force of the second spring, so that the abutting device retracts from the movement area of the processing device, and the movement of the processing device in the outward direction is permitted.

* * * * *